US009339737B2

(12) United States Patent
Chan

(10) Patent No.: US 9,339,737 B2
(45) Date of Patent: May 17, 2016

(54) APPARATUS AND METHOD FOR GENERATING BUBBLES

(71) Applicant: Honor Metro Limited, Tortola (VG)

(72) Inventor: Adam Hing Ping Chan, Hong Kong (CN)

(73) Assignee: HONOR METRO LIMITED (VG)

( * ) Notice: Subject to any disclaimer, the term of this patent is extended or adjusted under 35 U.S.C. 154(b) by 145 days.

(21) Appl. No.: 14/245,767

(22) Filed: Apr. 4, 2014

(65) Prior Publication Data

US 2015/0265940 A1 Sep. 24, 2015

(30) Foreign Application Priority Data

Mar. 20, 2014 (CN) ..... 2014 1 01054649

(51) Int. Cl.
*A63H 33/28* (2006.01)

(52) U.S. Cl.
CPC ..... *A63H 33/28* (2013.01)

(58) Field of Classification Search
USPC ..... 446/15–21
See application file for complete search history.

(56) References Cited

U.S. PATENT DOCUMENTS 2,412,732 A * 12/1946 Holman ..... A63H 33/28 40/408
2,632,281 A * 3/1953 Schmidt, Jr. ..... A63H 33/28 40/408
2,942,375 A * 6/1960 Bucic, Jr. ..... A63H 33/28 446/15
2,974,438 A * 3/1961 Hopkins ..... A63H 33/28 446/16
3,708,909 A * 1/1973 Winston ..... A63H 33/28 446/16
4,133,138 A * 1/1979 Coons ..... A63H 33/28 446/16
4,775,348 A * 10/1988 Collins ..... A63H 33/28 446/15
5,542,869 A * 8/1996 Petty ..... A63H 33/28 446/16
6,200,184 B1 3/2001 Rich et al.
6,241,571 B1 * 6/2001 Chow ..... A63H 33/28 446/16
6,328,286 B1 12/2001 Sanchez et al.
6,331,130 B1 12/2001 Thai
7,021,986 B2 4/2006 Thai (Continued)

FOREIGN PATENT DOCUMENTS

CN 2907813 6/2007
CN 2930817 8/2007
CN 201067639 6/2008

OTHER PUBLICATIONS

Corresponding search report from the EPO for EP 15159550 dated Jul. 27, 2015.

*Primary Examiner* — Melba Bumgarner
*Assistant Examiner* — Joseph B Baldori
(74) *Attorney, Agent, or Firm* — Belles Katz LLC

(57) ABSTRACT

A bubble generating device and a method for producing bubbles. In one aspect, the invention can be an apparatus for generating bubbles comprising: a housing; a motor; an air flow generator operably coupled to the motor; a trough containing a bubble solution; a cam surface comprising a raised portion and a valley portion; a follower member comprising a bubble generating device, the follower member in operable cooperation with the cam surface; the motor operably coupled to the follower member to drive the follower member along the cam surface such that: (1) upon the follower member being located along the valley portion of the cam surface, the bubble generating device is in the trough; and (2) upon the follower member being located along the raised portion of the cam surface, the bubble generating device is aligned with an air flow generated by the air flow generator for producing bubbles.

21 Claims, 16 Drawing Sheets

(56) References Cited

U.S. PATENT DOCUMENTS

| | | | | |
|---|---|---|---|---|
| 7,144,291 | B2 | 12/2006 | Thai | |
| 7,172,484 | B2 | 2/2007 | Thai | |
| 7,731,064 | B2 * | 6/2010 | Chuang | B05B 9/01 222/175 |
| 7,780,497 | B2 | 8/2010 | Thai | |
| 8,038,500 | B2 * | 10/2011 | Thai | A63H 33/28 446/15 |
| 8,123,584 | B2 | 2/2012 | Thai | |
| 8,272,915 | B2 | 9/2012 | Thai | |
| 8,272,916 | B2 * | 9/2012 | Thai | A63H 33/28 446/15 |
| 2003/0116224 | A1 | 6/2003 | Crawford et al. | |
| 2009/0163109 | A1 * | 6/2009 | Thai | A63H 33/28 446/16 |
| 2009/0209163 | A1 | 8/2009 | Thai | |
| 2011/0081821 | A1 * | 4/2011 | Temiz | A63H 33/28 446/16 |
| 2012/0220184 | A1 * | 8/2012 | Orem | A63H 33/28 446/16 |
| 2015/0133021 | A1 * | 5/2015 | Huey | A63H 33/28 446/15 |
| 2015/0265940 | A1 * | 9/2015 | Chan | A63H 33/28 446/16 |

* cited by examiner

APPARATUS AND METHOD FOR GENERATING BUBBLES

CROSS-REFERENCE TO RELATED APPLICATIONS

The present application claims priority to Chinese Patent Application No. 2014101054649, filed on Mar. 20, 2014, the entirety of which is incorporated herein by reference.

FIELD OF THE INVENTION

The present invention relates to apparatuses for generating bubbles and methods of generating bubbles.

BACKGROUND OF THE INVENTION

Children love bubbles and the bubble makers that are used to create them. At least as far as children are concerned, there is a general understanding that the more bubbles that are made and the quicker they are made, the better the bubble maker. Simple wands that produce bubbles by loading the wands with a bubble solution and blowing through the wands with air from a person's mouth are well known. Furthermore, certain types of automated bubble producing devices, such as bubble producing guns, are also known. However, these types of devices can make a terrible mess in the hands of a child (the same goes for some adults, too). For purposes of generating more bubbles, and making less of a mess, stand-alone bubble generating toys have been designed. Such a toy generates bubbles by forming a film of bubble solution using an applicator as the solution streams through bubble-forming openings. This type of bubble generating toy requires bubble solution to be pumped from a reservoir at the base of the assembly and streamed over the bubble-forming openings. Furthermore, excess bubble solution must be collected so that it can be directed back into the reservoir. Toys of this type also blow air through small air tubes, which direct the air to the bubble-forming openings to help form the bubbles.

Existing automated bubble making devices must run for a period of time before any bubbles are created, thus leading users to become bored while waiting for the production of bubbles. Furthermore, existing automated bubble making devices are messy, difficult and expensive to manufacture, and difficult to use. Thus, a need exists for an apparatus for generating bubbles which overcomes the above-noted deficiencies.

BRIEF SUMMARY OF THE INVENTION

Exemplary embodiments according to the present disclosure are directed to an apparatus for generating bubbles and to a method of generating bubbles. The apparatus may include a housing, a motor and an air generating device operably coupled to the motor. The apparatus may further include a bubble generating assembly. The bubble generating assembly may ride along a cam surface to transition between a lowered position in which bubble solution is loaded onto the bubble generating assembly and a raised position in which air generated by the air generating device flows through the loaded bubble generating assembly to produce bubbles.

In one aspect, the invention can be an apparatus for generating bubbles comprising: a housing; a motor, a fan device operably coupled to the motor to generate an air stream; a bubble generating assembly comprising a body and a follower member having a bubble generating device, the motor operably coupled to the bubble generating assembly to rotate the bubble generating assembly about a first rotational axis, the follower member pivotably coupled to the body so as to be pivotable about a second rotational axis; an annular cam surface comprising a raised portion and a valley portion, the annular cam surface circumscribing the first rotational axis, the follower member in operable cooperation with the annular cam surface; wherein upon the bubble generating assembly being rotated about the first rotational axis by the motor, the follower member rides along the annular cam surface to repetitively transition between: (1) a lowered position in which the follower member is located along the valley portion of the annular cam surface and the bubble generating device becomes loaded with bubble solution; and (2) a raised position in which the follower member is located along the raised portion of the annular cam surface and the bubble generating device is aligned with the air stream generated by the fan; and wherein the follower member transitions between the raised position and the lowered position by rotating about the second rotational axis.

In another aspect, the invention can be an apparatus for generating bubbles comprising: a housing; at least one motor; an air flow generator operably coupled to the at least one motor; a trough for containing a bubble solution; a cam surface comprising a raised portion and a valley portion; a follower member comprising a bubble generating device, the follower member in operable cooperation with the cam surface; the at least one motor operably coupled to the follower member to drive the follower member along the cam surface in a repetitive cycle such that: (1) upon the follower member being located along the valley portion of the cam surface, the bubble generating device of the follower member is in the trough for loading with the bubble solution; and (2) upon the follower member being located along the raised portion of the cam surface, the bubble generating device of the follower member is aligned with an air flow generated by the air flow generator for producing bubbles from the bubble solution loaded on the bubble generating device.

In yet another aspect, the invention can be a method of generating bubbles comprising: filling a trough with a bubble solution; generating an air stream with an air stream generator that is operably coupled to a motor; moving a follower member having a bubble generating device along a cam surface, the cam surface comprising a raised portion and a valley portion; loading the bubble solution onto the bubble generating device when the follower member is located along the valley portion of the cam surface; and flowing the air stream through the bubble generating device when the follower member is located along the raised portion of the cam surface to produce bubbles from the bubble solution loaded on the bubble generating device.

In a further aspect, the invention can be a bubble producing flameless torch apparatus comprising: a housing; a rod coupled to the housing; at least one motor; an air flow generator operably coupled to the at least one motor; a trough for containing a bubble solution; a cam surface comprising a raised portion and a valley portion; a follower member comprising a bubble generating device, the follower member in operable cooperation with the cam surface; the at least one motor operably coupled to the follower member to drive the follower member along the cam surface in a repetitive cycle such that: (1) upon the follower member being located along the valley portion of the cam surface, the bubble generating device of the follower member is in the trough for loading with the bubble solution; and (2) upon the follower member located along the raised portion of the cam surface, the bubble generating device of the follower member is aligned with an air flow generated by the air flow generator for producing bubbles from the bubble solution loaded on the bubble generating device.

In a still further aspect, the invention can be a bubble producing flameless torch apparatus comprising: a housing; a source of bubble solution; an elongated rod coupled to the housing; an illumination source coupled to the housing; at least one motor; an air flow generator operably coupled to the at least one motor to generate an air stream; and a bubble generating device configured to: (1) be loaded with the bubble solution from the source of bubble solution to form a loaded bubble generating device; and (2) produce bubbles from the bubble solution by flowing the air stream generated by the air flow generator through the loaded bubble generating device.

In another aspect, the invention can be a bubble producing apparatus comprising: a housing having a closed bottom end and an open top end; a source of bubble solution; an elongated rod coupled to the closed bottom end of the housing; and a bubble generating device configured to produce bubbles from the bubble solution, the bubbles flowing upwardly from the open top end of the housing.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
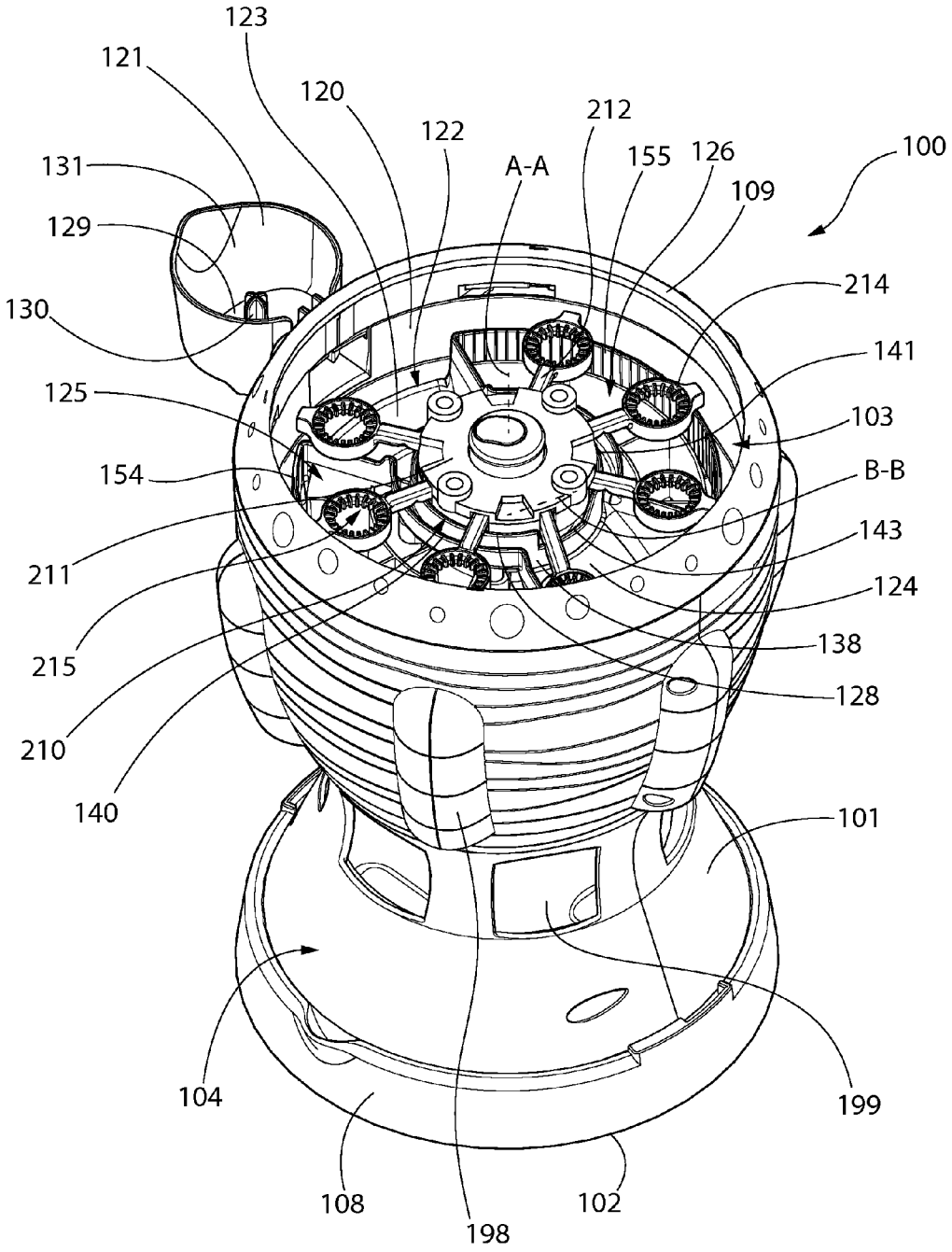
FIG. 1 is a perspective view of an apparatus for generating bubbles in accordance with one embodiment of the present invention.
Figure 2:
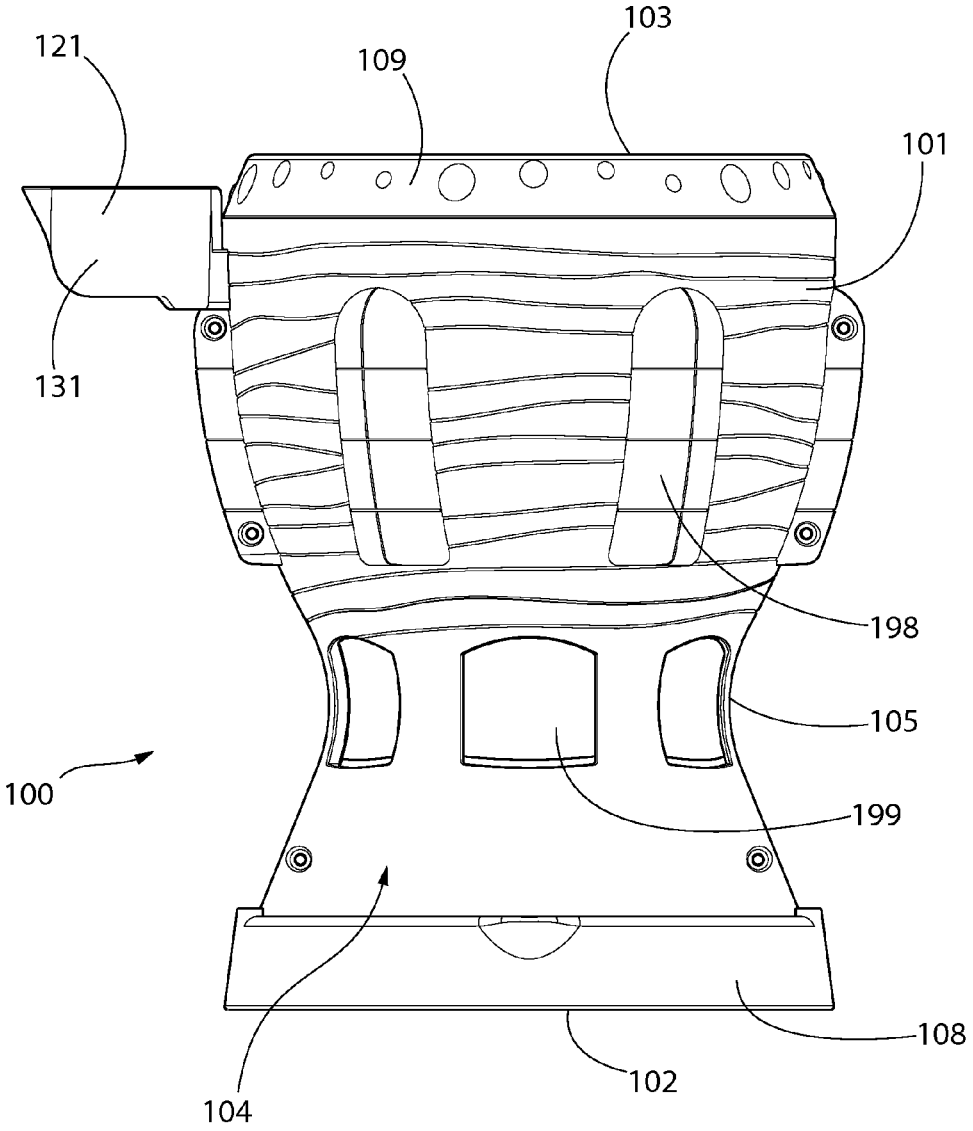
FIG. 2 is a front view of the apparatus for generating bubbles of FIG. 1.
Figure 3:
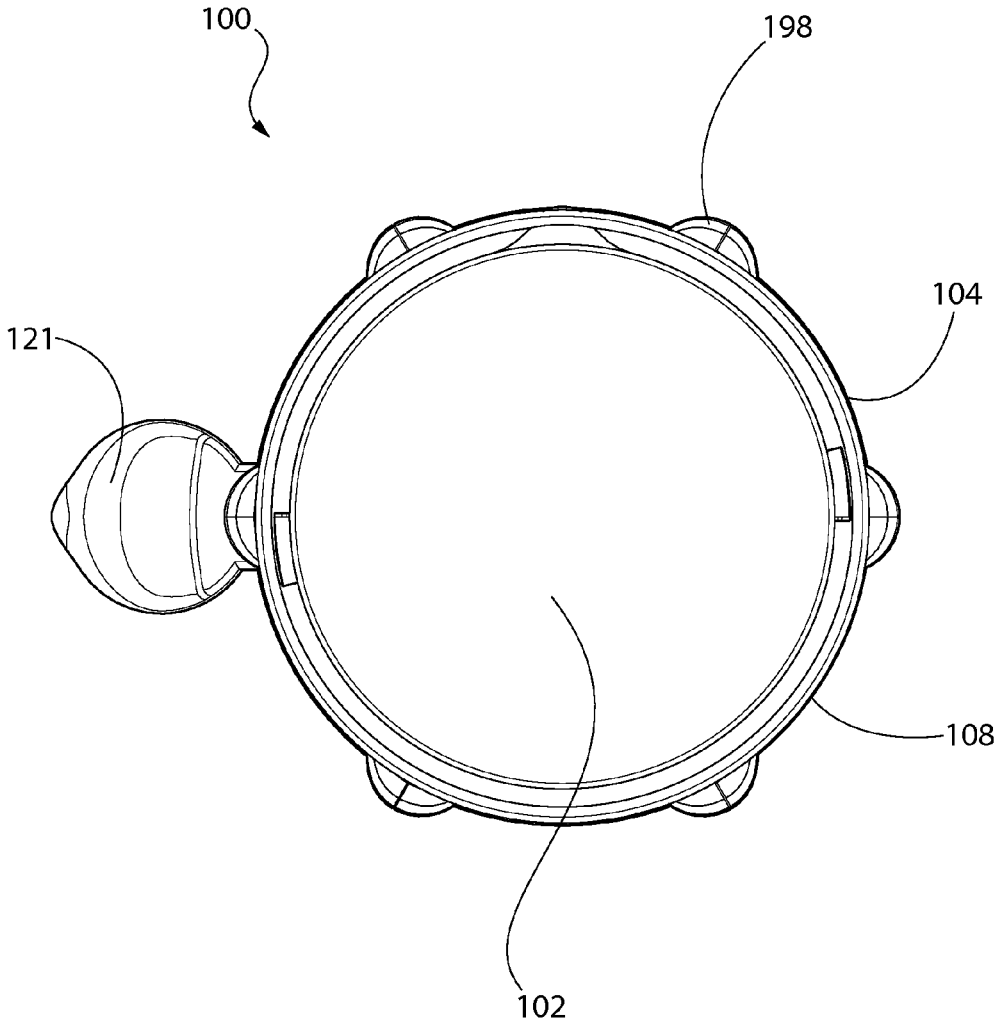
FIG. 3 is a bottom view of the apparatus for generating bubbles of FIG. 1.
Figure 4:
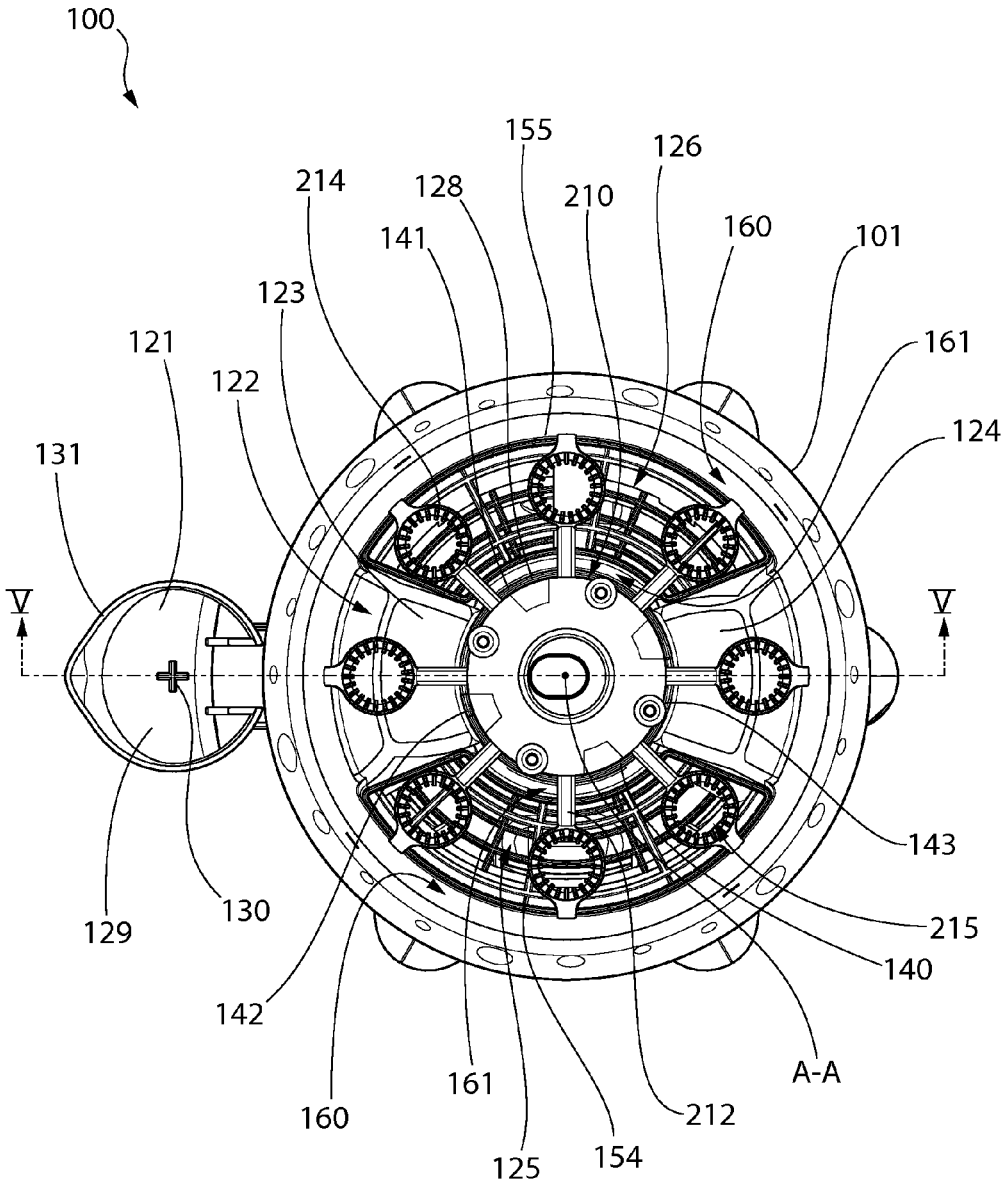
FIG. 4 is a top view of the apparatus for generating bubbles of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIGS. 1-4 and 7 concurrently, an apparatus for generating bubbles 100 (hereinafter "the apparatus 100") will be described in accordance with an embodiment of the present invention. The apparatus 100 comprises a housing 101 having a closed bottom end 102, an open top end 103 and an outer surface 104. Of course, in certain embodiments the bottom end 102 may be partially or entirely open. The housing 101 has various openings 199 and protrusions 198 along its outer surface 104 for aesthetic purposes. The openings 199 may also assist in air generation by permitting the inflow of air into the housing 101 that is used to generate an air stream by an air generating device, as discussed in more detail below. However, the outer surface 104 can have any ornamental design desirable. In the exemplified embodiment, the housing 101 has an hourglass-like shape with a waist portion 105 that is narrowed relative to the remainder of the housing 101. Of course, the invention is not to be so limited in all embodiments and the outer surface 104 may have a constantly shaped profile, such as being square-shaped, rectangular shaped or the like in other embodiments. The housing 101 can take on virtually any shape.

Furthermore, in the exemplified embodiment the housing 101 comprises a first shell 106 and a second shell 107 that are separable from one another to facilitate manufacture of the apparatus 100. The housing 101 also includes a base plate 108 that forms the closed bottom end 102 and an upper ring 109 that surrounds the open top end 103. The housing 101 is preferably formed of a rigid material, such as a hard plastic including for example without limitation thermoset or thermoplastic polymers such as polyolefins which include polyethylene, polyester, polyurethane and the like. Of course, other materials can be used to form the housing 101 as would be readily selectable by persons of ordinary skill in the art.

In the exemplified embodiment, the housing 101 houses and/or contains all of the components of the apparatus 100. Thus, the first and second shells 106, 107 are coupled together (with screws, fasteners, tight-fit, interference fit, adhesion, or the like) and the remaining components of the apparatus 100 are positioned within the housing 101. However, the invention is not to be so limited in all embodiments and in certain other embodiments some of the components of the apparatus 100 may be positioned external to the housing 101 while still being in operable communication with the other components to enable the apparatus 100 to produce bubbles as will be described in more detail below.

Figure 5:
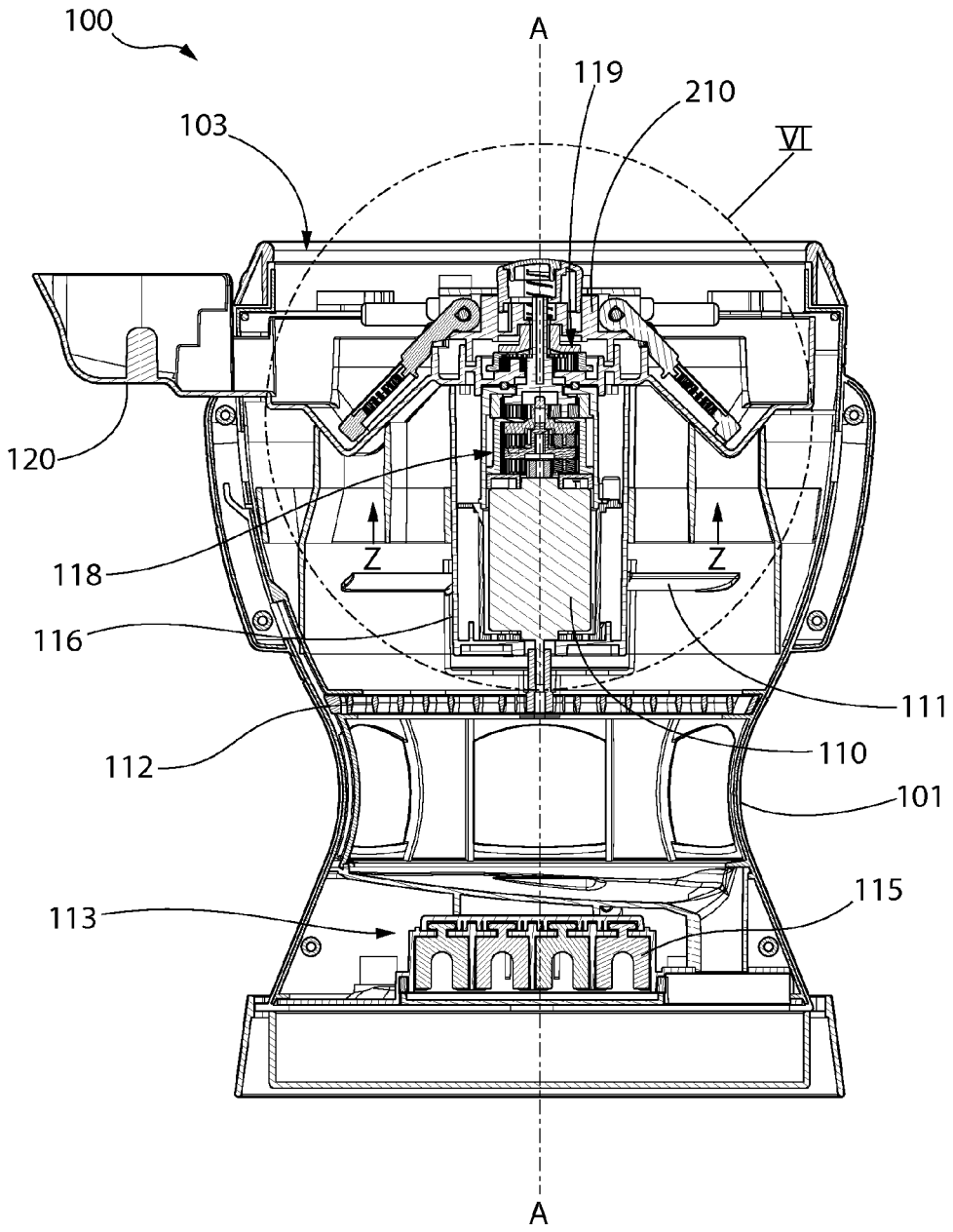
FIG. 5 is a cross-sectional view taken along line V-V of FIG. 4.
Figure 6:
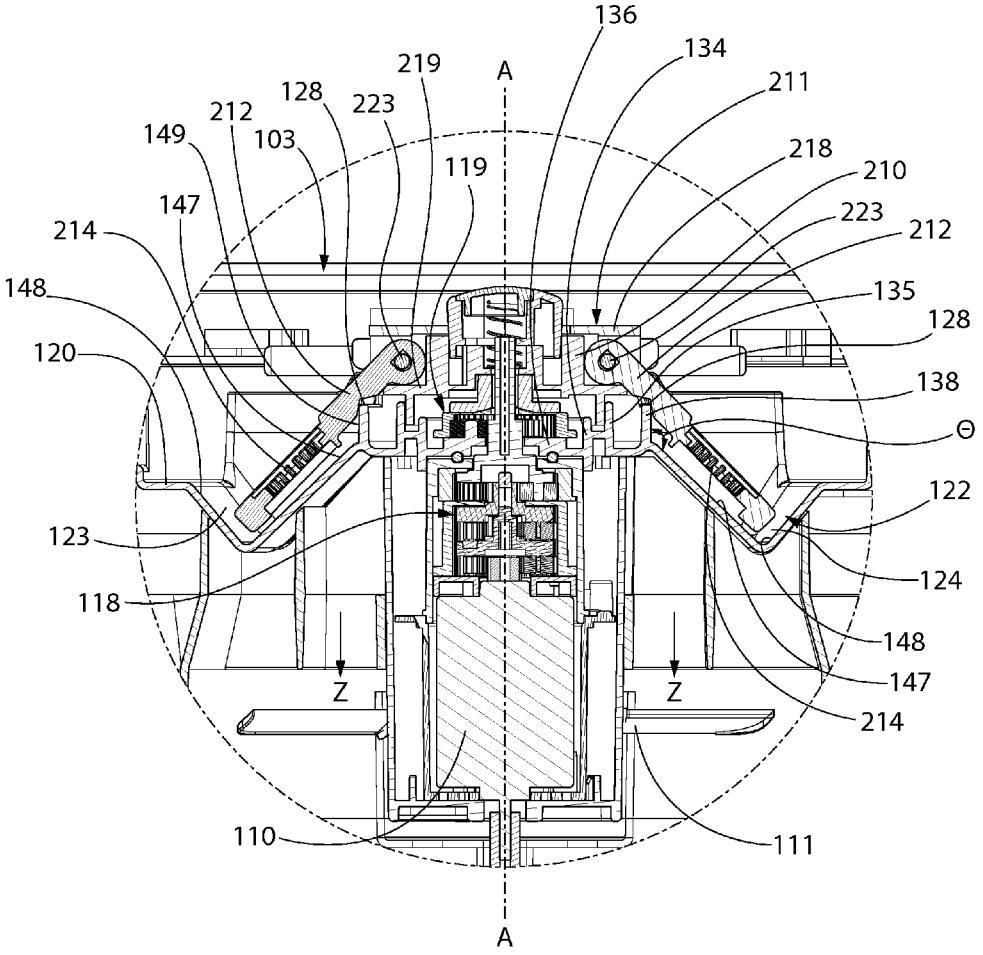
FIG. 6 is an enlarged view of area VI of FIG. 5.
Figure 7:
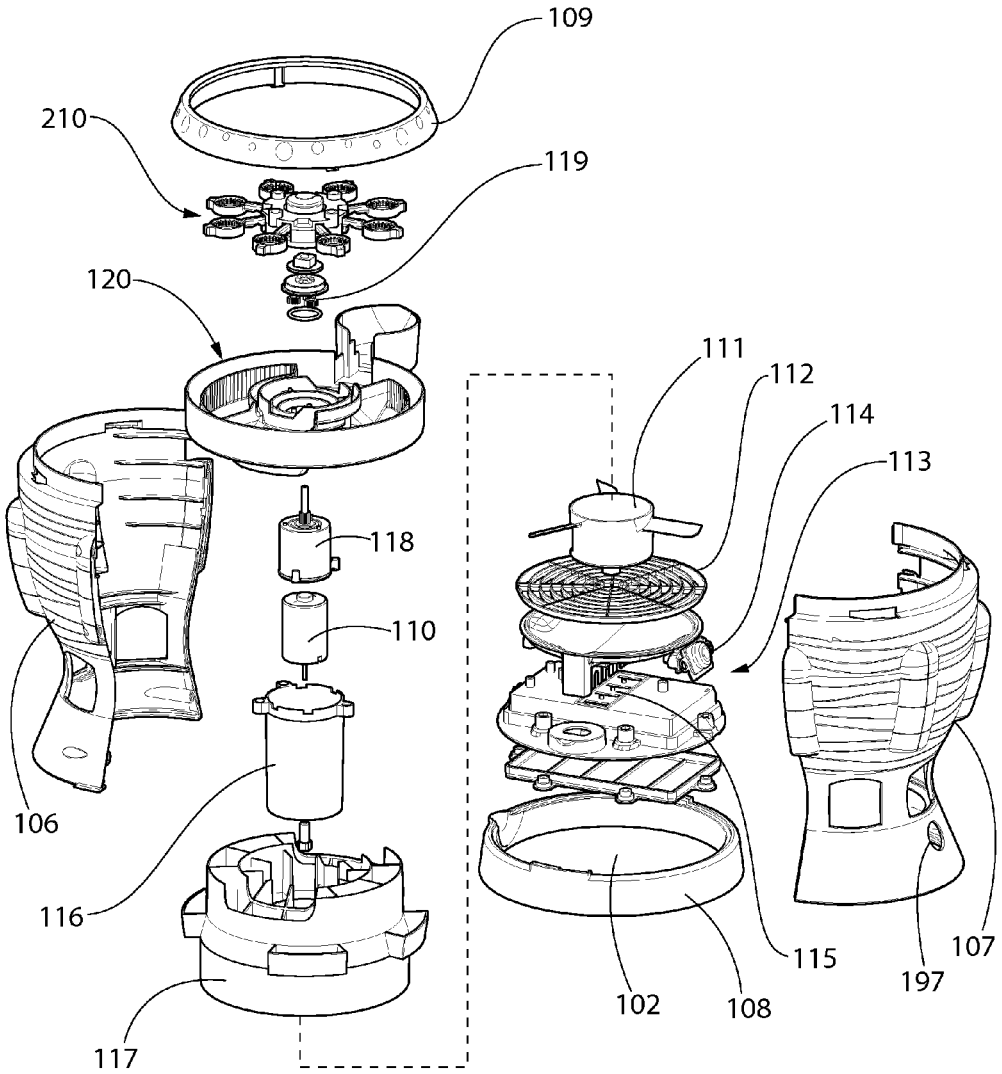
FIG. 7 is an exploded view of the apparatus for generating bubbles of FIG. 1.

Referring briefly to FIGS. 5-7, the various components of the apparatus 100 will be briefly described, it being understood that a more detailed description of each of these components will be provided below. In addition to the housing 101, the apparatus 100 generally comprises a motor 110, an air flow generator 111 for generating an air stream or air flow, a grate 112 to prevent a user from contacting the blades of the air flow generator 111 by preventing a user's fingers from being able to contact the air flow generator 111 if the user's fingers are inserted into the openings 199, a power sub-system 113 that includes a power button 114, battery contacts 115 and all other components necessary to power on the apparatus 100 for use thereof.

In the assembled apparatus 100, the power button 114 may be exposed through an opening 197 formed through the housing 101. The apparatus 100 also includes a shroud 116 for protecting the motor 110 against water or liquid damage and a gear housing 117 for housing the various gears (including the gears 118 and 119) that facilitate transferring movement from the motor to the various components of the apparatus 100 at a desired speed. The apparatus 100 also includes a basin member 120 and a bubble generating assembly 210.

The motor 110 is operably coupled to a power source (such as batteries) to enable the motor 110 to rotate about a rotational axis. In the exemplified embodiment, the air flow generator 111 is a fan device having blades thereon so that during rotation of the air flow generator 11, the blades generate an air stream which flows upwardly through the housing 101 in the direction of the arrows Z towards the open top end 103 of the housing 101. Of course, the air flow generator 111 need not be a fan device in all embodiments and the air flow generator 111 can be any other device capable of generating an air stream for bubble production as discussed herein. In the exemplified embodiment, the air flow generator 111 is operably coupled to the motor 110 so that during rotation of the motor, the air flow generator 111 also rotates. In the exemplified embodiment the air flow generator 111 is directly coupled to the motor 110 so that the air flow generator 111 rotates at the same rotational speed as the motor 110. However, the invention is not to be so limited in all embodiments and the air flow generator 1110 may be coupled to the motor 110 indirectly via a gear train so that the air flow generator 111 may rotate faster (via step up gears) or slower (via step down gears) than the motor 110.

In the exemplified embodiment, the bubble generating assembly 210 is also operably coupled to the motor 110 so that the bubble generating assembly 210 is made to rotate during operation. More specifically, the bubble generating assembly 210 rotates about a first rotational axis A-A during operation of the apparatus 100. Of course, the invention is not to be so limited in all embodiments and in certain other embodiments the bubble generating assembly 210 may translate in a linear direction rather than moving in a rotational direction. Thus, movement directions other than that illustrated in the exemplified embodiment are possible and are within the scope of the present invention. In the exemplified embodiment, the bubble generating assembly 210 is indirectly coupled to the motor 110 via various ones of the gears 118, 119. It may be desired to rotate the bubble generating assembly 210 at a slower speed than the rotation of the motor 110, and thus the gears 118, 119 may be step down gears that facilitate slower movement of the bubble generating assembly 210 than the motor 110. The bubble generating assembly 210 comprises bubble generating devices that can be loaded with bubble solution so that as the air stream generated by the air stream generator 111 flows through the bubble generating devices that are pre-loaded with a bubble solution, bubbles are formed. This will be described in more detail below.

Figure 11:
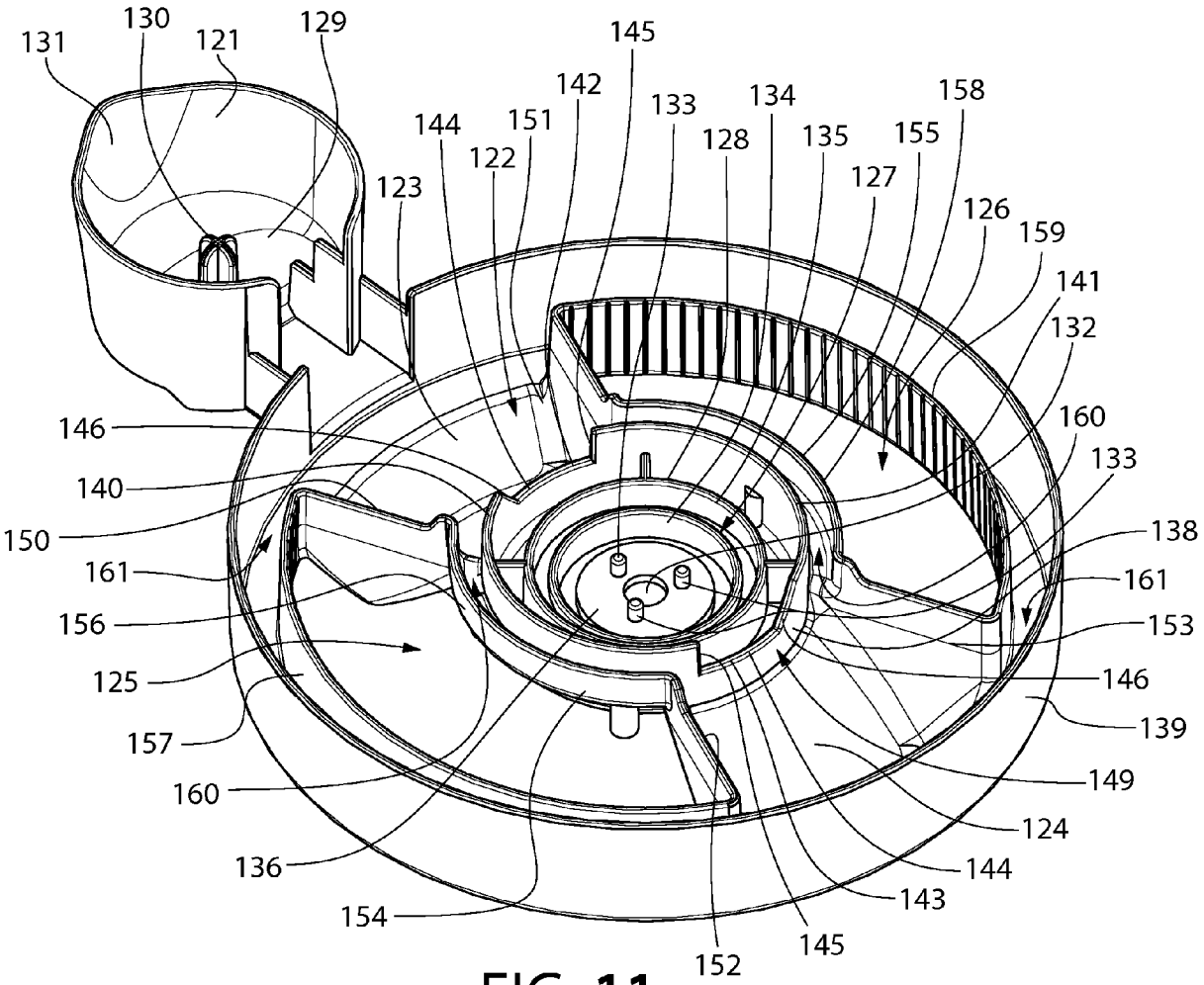
FIG. 11 is a perspective view of a basin member of the apparatus for generating bubbles of FIG. 1.

Referring to FIGS. 1, 4, 10 and 11 concurrently, the apparatus 100 will be described in more detail. As noted above, the apparatus 100 includes a basin member 120, which is depicted in FIG. 11 in isolation. The outer boundaries of the basin member 120 are formed by a perimetric wall 139. Although in the exemplified embodiment all of the various parts of the basin member 120 are illustrated as being formed into a single unitary structure, the invention is not to be so limited in all embodiments and in certain other embodiments the various parts of the basin member 120 may be individual components that are positioned within the apparatus 100 in such a manner to enable them to cooperate as needed to achieve the desired bubble generation.

In the exemplified embodiment, the basin member 120 includes a gravity-feed reservoir 121, a trough 122 comprising a first reservoir 123 and a second reservoir 124, a first air flow opening 125, a second air flow opening 126, a connection section 127 for coupling the bubble generating assembly 210 to the basin member 120 and a cam surface 128.

The gravity-feed reservoir 121 includes a floor 129, a protrusion 130 extending upwardly from the floor 129 at a center point of the floor 129 and a cylindrical wall 131 forming a periphery of the gravity-feed reservoir 121. During use, a bottle containing a bubble solution may be placed upside-down within the gravity-feed reservoir 121 so that the open end of the bottle is adjacent the floor 129 of the gravity-feed reservoir 121. In this position, the protrusion 130 will enter into an opening in the top of the bottle and the cylindrical wall 131 will surround a portion of an outer surface of the bottle. The combination of the cylindrical wall 131 surrounding a portion of the outer surface of the bottle and the protrusion 130 extending into the opening of the bottle will facilitate maintaining the bottle in this upside-down position without requiring the user to hold the bottle in place. In certain embodiments, the opening of the bottle may be closed by a film of plastic or by a piece of rubber material. The protrusion 130 will extend into the opening in the bottle, and may serve to pierce such a film of plastic or piece of rubber material that is covering the opening in the bottle to enable the bubble solution to flow out from the bottle and into the gravity-feed reservoir 121. After filling the gravity-feed reservoir 121, the bubble solution will flow into the trough 122. The flow of the bubble solution from the bottle to the gravity-feed reservoir 121 and from the gravity-feed reservoir 121 to the trough 122 will be described in more detail below with particular reference to FIG. 12.

Referring to FIGS. 1, 4, 6, 10 and 11, the connection section 127, the cam surface 128 and the trough 122 will be described in more detail. The connection section 127 comprises a platform 136 having an aperture 132 therein for receiving a connection mechanism such as a bolt, a screw, a fastener or the like to couple the bubble generating assembly 210 to the basin member 120. The platform 136 also includes protuberances 133 that facilitate the coupling of the bubble generating assembly 210 to the basin member 120. Furthermore, the connection section 127 comprises two concentric upstanding walls 134, 135 to further facilitate the coupling of the bubble generating assembly 210 to the basin member 120.

The cam surface 128 is a top surface of a cam wall 138 that extends upwardly from the basin member 120. In the exemplified embodiment, the cam wall 138, and thereby also the cam surface 128, is an annular structure. Thus, in the exemplified embodiment the cam wall 138 concentrically surrounds each of the two concentric upstanding walls 134, 135 and the platform 136. Similarly, the cam wall 138 and the cam surface 128 circumscribe the first rotational axis A-A. However, the invention is not to be so limited in all embodiments such that the cam wall 138 and the cam surface 128 need not be annular in shape in all embodiments. Rather, the cam wall 138 and the cam surface 128 can take on other shapes such as being linear or having any closed polygonal shape. As discussed in more detail below, during operation the cam surface 128 is stationary or non-movable. A follower member of the bubble generating assembly 210 moves relative to and along the cam surface 128 while the cam surface 128 remains stationary to achieve the functionality of the apparatus 100.

In the exemplified embodiment, the cam surface 128 comprises a first raised portion 140, a second raised portion 141, a first valley portion 142 and a second valley portion 143. However, the invention is not to be so limited in all embodiments and in certain other embodiments the cam surface 128 may only include one raised portion and one valley portion, or the cam surface 128 may include three or more raised portions and three or more valley portions. Thus, the invention is not to be particularly limited by the number of raised and valley portions that form the cam surface 128 in all embodiments.

In the exemplified embodiment, each of the first and second raised portions 140, 141 is a flat portion of the top surface of the cam wall 138 that extends to a height greater than the height of each of the valley portions 142, 143. Thus, the valley portions 142, 143 of the cam surface 128 are lowered or recessed relative to the raised portions 140, 141 of the cam surface 128. Each of the valley portions 142, 143 of the cam surface 128 comprise a floor 144, a first wall 145 extending upwardly from the floor 144 to one of the raised portions 140, 141 and a second wall 146 extending upwardly from the floor 144 to the other one of the raised portions 140, 141. Specifically, referring to the valley portion 143, the valley portion 143 has the first wall 145 which extends from the floor 144 to the first raised portion 140 and the second wall 146 which extends from the floor 144 to the second raised portion 141. The valley portion 142 has a first wall 145 which extends from the floor 144 to the second raised portion 141 and a second wall 146 that extends from the floor 144 to the first raised portion 140.

The floor 144 of the valley portions 142, 143 is a substantially planar flat surface. The first wall 145 extends upwardly from the floor 144 at an approximately 90° angle such that the first wall 145 is substantially perpendicular to the floor 144. Substantially perpendicular can include the first wall 145 forming an angle with the floor 144 of between 88-92° in one embodiment, between 85-95° in another embodiment, between 80-100° in a further embodiment or between 70-110° in a still further embodiment. The second wall 146 extends upwardly from the floor 144 so as to form an obtuse angle between the floor 144 and the second wall 146. Specifically, the obtuse angle may be between 100-170° in one embodiment, more specifically between 110-210° in another embodiment, more specifically between 120-150° in yet another embodiment, and still more specifically between 130°-140° in a further embodiment. Thus, the second wall 146 forms a ramp on the cam surface 128, the purpose of which will be discussed in more detail below.

As noted above, the trough 122, in the exemplified embodiment, comprises a first reservoir 123 and a second reservoir 124. Of course, the invention is not to be limited by the number of reservoirs included in the trough 122 in all embodiments. In certain other embodiments the trough 122 may only include one reservoir, or the trough 122 may include three, four or more reservoirs in other embodiments. The trough 122 is intended to receive and contain a bubble solution therein for application onto the bubble generating assembly 210, which will be described in more detail below.

Each of the first and second reservoirs 123, 124 of the trough 122 comprises a floor 147 and a sidewall 148 extending upwardly from the floor 147 at an approximately 90° angle. Of course, the sidewall 148 can extend upwardly from the floor at angles that are greater than or less than 90°, such as an angle between 88-92°, between 85-95°, between 80-100° or the like. The floor 147 of each of the first and second reservoirs 123, 124 of the trough 122 extends downwardly from an outer surface 149 of the annular cam wall 138 thereby forming an obtuse angle θ between the floor 147 of the trough 122 (or the floor 147 of each of the first and second reservoirs 123, 124 of the trough 122) and the annular cam wall 138. The obtuse angle θ may be any angle that is greater than 90° and less than 180°, but more preferably is between approximately 110° and 160°, or even more preferably between approximately 120° and 150°, and still more preferably between approximately 130° and 140°. When in use, the bubble solution fills up each of the first and second reservoirs 123, 124 of the trough 122 as will be discussed in more detail below with reference to FIG. 12.

In the exemplified embodiment, the first reservoir 123 is spaced apart from the second reservoir 124 about the first rotational axis A-A. More specifically, in the exemplified embodiment, a center of the first reservoir 123 is circumferentially spaced approximately 180° from a center of the second reservoir 124. The first reservoir 123 comprises a first side 150 and an opposing second side 151 and the second reservoir 124 comprises a first side 152 and an opposing second side 153. In the exemplified embodiment, adjacent sides of the first and second reservoirs 123, 124 (i.e., the first side 150 of the first reservoir 123 is adjacent to the first side 152 of the second reservoir 124 and the second side 151 of the first reservoir 123 is adjacent to the second side 153 of the second reservoir 124) are spaced apart less than 180° about the first rotational axis A-A because each one of the reservoirs 123, 124 spans a distance about the first rotational axis A-A. Of course, the invention is not to be so limited and the center-to-center spacing between the first and second reservoirs 123, 124 can be less than 180° in other embodiments, such as the first and second reservoirs 123, 124 being spaced apart by approximately 30°, 45°, 60°, 90°, 120°, 150° or the like.

The basin member 120 also includes the first air flow opening 125 and the second air flow opening 126. In the exemplified embodiment, each of the first and second air flow openings 125, 126 are arcuate in shape, although other shapes are certainly possible in other embodiments. Specifically, the first and/or second air flow openings 125, 126 may be circular, ovular, rectangular or the like. Although two air flow openings are depicted in the drawings, the invention is not to be so limited in all embodiments and in certain other embodiments the apparatus 100 may include more than two air flow openings or just a single air flow opening.

In the exemplified embodiment each of the first and second air flow openings 125, 126 spans between 90° and 150° about the cam wall 138, more specifically between 100° and 140° about the cam wall 138, and still more specifically between 110° and 130° about the cam wall 138. Thus, the two air flow openings 125, 126 collectively span approximately 220° to 260° about the cam wall 138, and the two reservoirs 123, 124 collectively span approximately 100° to 160° about the cam wall 138. Without desiring to be particularly limited in this regard in all embodiments, in the exemplified embodiment each of the first and second air flow openings 125, 126 has a greater area (i.e., takes up more space) than each of the first and second reservoirs 123, 124. The first and second air flow openings 125, 126 are formed by holes or apertures that extend through the basin member 120. Due to the holes or apertures, the air stream or air flow that is generated by the air flow generator 111 flows upwardly towards the basin member 120 in the direction of the arrows Z (FIG. 6), and then flows through the first and second air flow openings 125, 126.

The first air flow opening 125 is defined by or surrounded by a first upstanding wall 154 and the second air flow opening 126 is defined by or surrounded by a second upstanding wall 155. In the exemplified embodiment, the first upstanding wall 154 forms an uninterrupted closed perimeter that surrounds the first air flow opening 125 and the second upstanding wall 155 forms an uninterrupted closed perimeter that surrounds the second air flow opening 126. Of course, the invention is not to be so limited and in certain other embodiments each of the first and second upstanding walls 154, 155 may be formed by wall segments that are spaced apart from one another. In still other embodiments the first and second upstanding walls 154, 155 may partially, but not entirely, surround the first and second air flow openings 125, 126. In still other embodiments, the first and second upstanding walls 154, 155 may be altogether omitted. As will be discussed in more detail below, the first and second upstanding walls 154, 155 assist in the formation of channels between the first and second reservoirs 123, 124 to enable the bubble solution to flow between the first and second reservoirs 123, 124.

In the exemplified embodiment, the first air flow opening 125 is located between the first side 150 of the first reservoir 123 and the first side 152 of the second reservoir 124.

Furthermore, the second air flow opening 126 is located between the second side 151 of the first reservoir 123 and the second side 153 of the second reservoir 124. Thus, the reservoirs 123, 124 and the air flow openings 125, 126 alternate in position when moving in a rotational direction about the cam wall 138. Furthermore, the first raised portion 140 of the cam surface 128 is aligned with the first air flow opening 125, the second raised portion 141 of the cam surface 128 is aligned with the second air flow opening 126, the first valley portion 142 of the cam surface 128 is aligned with the first reservoir 123 and the second valley portion 143 of the cam surface 128 is aligned with the second reservoir 124. The term aligned, as used in this paragraph, simply indicates whether a reservoir or an air flow opening is adjacent to the raised portions and valley portions of the cam surface 128.

To visualize, the basin member 120, which in the exemplified embodiment is round or circular in shape, can be divided into four pie shaped segments such that a first pie shaped segment encompasses the first valley portion 142 of the cam surface 128 and the first reservoir 123, a second pie shaped segment encompasses the first raised portion 140 of the cam surface 128 and the first air flow opening, a third pie shaped segment encompasses the second valley portion 143 of the cam surface 128 and the second reservoir 124, and a fourth pie shaped segment encompasses the second raised portion 141 of the cam surface 128 and the second air flow opening 126. This relative positioning of the raised and valley portions 140, 141, 142, 143 of the cam surface 128 relative to the air flow openings 125, 126 and to the reservoirs 123, 124 enables bubble solution to be loaded onto a bubble generating device when the bubble generating device is positioned within the trough 122 (or within one of the reservoirs 123, 124 of the trough 122) and then enables the air stream generated by the air flow generator 111 to flow through the loaded bubble generating device to produce bubbles when the bubble generating device is positioned over and aligned with one of the air flow openings 125, 126, as will be discussed in more detail below with reference to FIGS. 13A-D and 14.

The first upstanding wall 154 has an inner portion 156 and an outer portion 157. Similarly, the second upstanding wall 155 has an inner portion 158 and an outer portion 159. A first channel 160 is formed between the cam wall 138 and the inner portions 156, 158 of each of the first and second upstanding walls 154, 155. A second channel 161 is formed between the outer portions 157, 159 of each of the first and second upstanding walls 154, 155 and the perimetric wall 139 of the basin member 120. In the exemplified each of the first and second channels 160, 161 is an annular channel. In that regard, in the exemplified embodiment, the first channel 160 has a first diameter and the second channel 161 has a second diameter, the second diameter being greater than the first diameter. Each of the first and second channels 160, 161 extends between the first reservoir 123 and the second reservoir 124. Thus each of the first and second channels 160, 161 fluidly couples the first reservoir 123 to the second reservoir 124.

Figure 12:
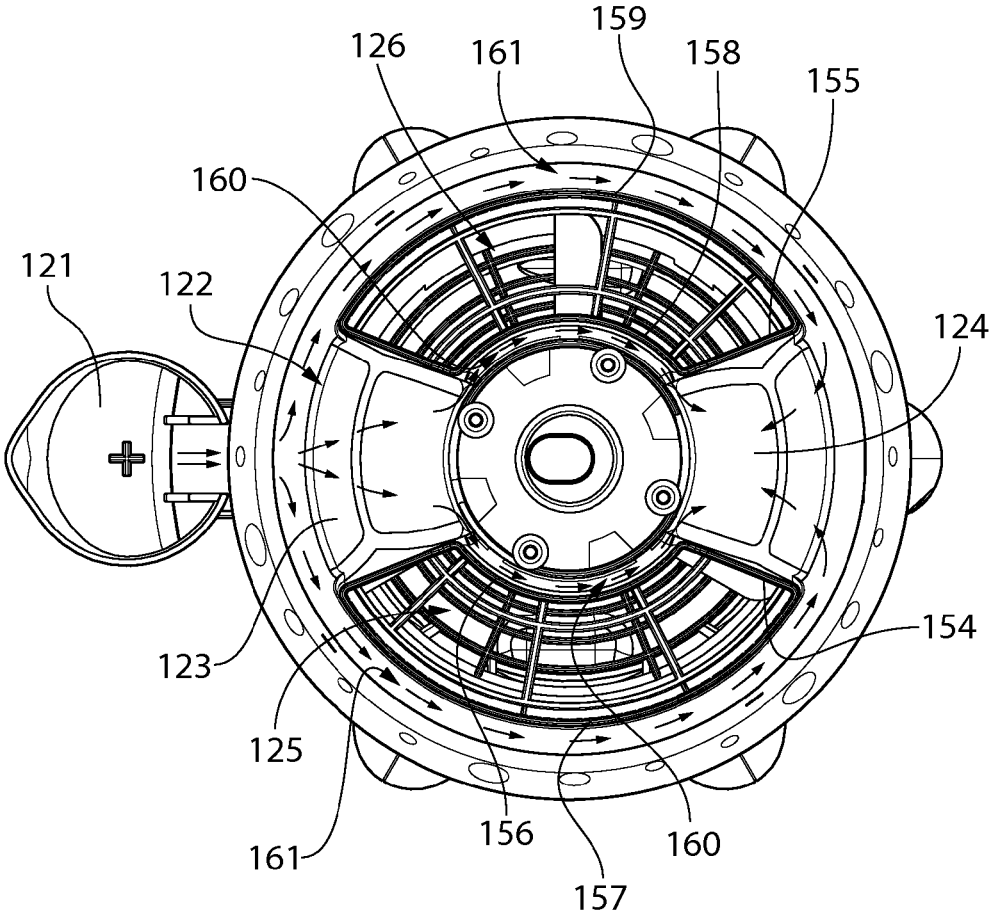
FIG. 12 is a top view of the apparatus for generating bubbles of FIG. 1 with directional arrows to indicate the direction of flow of bubble solution.

Referring to FIGS. 11 and 12 concurrently, the flow of the bubble solution into the first and second reservoirs 123, 124 and through the channels 160, 161 will be described. As noted above, a bottle of bubble solution can be positioned upside-down within the gravity-feed reservoir 121 to enable the bubble solution to flow out of the bottle and into the basin member 120. As the bubble solution flows out of the bottle, the bubble solution flows from the gravity-feed reservoir 121 and into the first reservoir 123. As the first reservoir 123 fills up with the bubble solution, the bubble solution begins to flow within and along each of the first and second channels 160, 161 in the direction of the second reservoir 124. This flow of the bubble solution within the channels 160, 161 is illustrated by the arrows in FIG. 12. The bubble solution continues to flow until either the bottle is empty of bubble solution, or until both of the reservoirs 123, 124 are filled with the bubble solution. Excess bubble solution may remain in the first and second channels 160, 161 in addition to the bubble solution located within the first and second reservoirs 123, 124. The bubble solution located within the reservoirs 123, 124 of the trough 122 can be loaded onto bubble generating devices during operation of the apparatus 100, as will be discussed in more detail below with specific references to FIGS. 13A-D and 14.

Referring now to FIGS. 1,4, 6, 8 and 9 concurrently, the bubble generating assembly 210 will be described in detail. The bubble generating assembly 210 generally comprises a body 211, a follower member 212 (only a few of the follower members 212 are labeled in the figures order to avoid clutter), a spring 228 and a cover 229. The body 211 of the bubble generating device 210 comprises an upper shell 218 and a lower shell 219 that are operably coupled together. In the exemplified embodiment, the bubble generating assembly 210 comprises a plurality of the follower members 212, and more specifically eight of the follower members 212, although any number of follower members 212 can be used in other embodiments. Each of the follower members 212 comprises a follower arm 213 and at least one bubble generating device 214. In the exemplified embodiment, each of the follower members 212 comprises exactly one bubble generating device 214. However, the invention is not to be so limited and in certain other embodiments each of the follower members 212 may include more than one bubble generating device 214 if desired.

In the exemplified embodiment, the bubble generating devices 214 are annular-shaped structures having an inner surface 216 that surrounds a central aperture 215. Furthermore, the bubble generating devices 214 comprise a plurality of ribs or ridges 217 protruding from the inner surface 216 in a spaced-apart manner. The ridges 217 assist in loading bubble solution onto the bubble generating devices 214. Specifically, when the bubble generating devices 214 are positioned within a reservoir that contains a bubble solution, the bubble solution will adhere to the bubble generating devices 214 along the ridges 217 on the inner surfaces 216 thereof. When bubble solution adheres to the bubble generating devices 214, those bubble generating devices 214 are considered to be loaded with the bubble solution.

The follower arms 213 of the bubble generating assembly 210 have a first end 220 that is coupled to the body 211 and a second end 221 that is coupled to one or more of the bubble generating devices 214. Furthermore, each of the follower arms 213 has a notch 227 formed into its underside or bottom surface, the purpose of which will be better understood from the description of FIGS. 13A-13D below. The second end 221 of the follower arms 213 may be integrally formed with one or more of the bubble generating devices 214. The first end 220 of each of the follower arms 213 has an aperture 222 formed therethrough to facilitate attachment of the follower arms 213 to a ring structure 223. Specifically, in the exemplified embodiment the follower arms 213 are rotatably or pivotably coupled to the ring structure 223. Although a ring structure 223 is depicted in the exemplified embodiment, each of the follower arms 213 may be rotatably or pivotably coupled to the body 211 in other manners, such as the upper and/or lower shells 218, 219 having protrusions which extend into the apertures 222 in the follower arms 213. Thus, the invention is not limited to the user of the ring structure 223 for coupling the follower arms 213 to the body 211 in all embodiments.

As noted above, the body 211 of the bubble generating device 210 comprises the upper shell 218 and the lower shell 219 that are operably coupled together. The upper shell 218 comprises a plurality of notches 224 positioned in a spaced apart manner along its perimetric outer surface and the lower shell 219 comprises a plurality of notches 225 formed in a spaced apart manner along its perimetric outer surface. When the upper shell 218 is operably coupled to the lower shell 219, the ring structure 223 and the first ends 220 of the follower arms 213 are trapped/positioned between the upper shell 218 and the lower shell 219. Furthermore, when the upper shell 218 is coupled to the lower shell 219, the notches 224 of the upper shell 218 are aligned with the notches 225 of the lower shell 219, thereby forming slots 226 in the body 211. The second ends 222 of each of the follower arms 213 are located within one of the slots 226 of the body 211 so that the follower arms 213 can pivot/rotate within the slot 226. More specifically, each one of the follower arms 213 is capable of rotating about a second rotational axis B-B within the slot 226 that it is positioned. The follower arms 213 are not capable of 360° rotation because the upper and lower shells 218, 219 of the body 211 prevent such a full degree of movement. However, the follower arms 213 are capable of sufficient pivotable or rotational movement so as to be movable within the slot 226 between a raised position and a lowered position, which will be discussed in more detail below with reference to FIGS. 13A-13D.

The bubble generating assembly 210 is operably coupled to the motor 110 so as to be rotatable about the first rotational axis A-A. The entirety of the bubble generating assembly 210 including the body 211 and the follower members 212 rotates together as a unit. In the exemplified embodiment, the bubble generating assembly 210 rotates about the first rotational axis A-A in a counter-clockwise direction. However, the invention is not to be so limited and the bubble generating assembly 210 may rotate about the first rotational axis A-A in a clockwise direction if desired. Furthermore, the bubble generating assembly 210 may move in a manner that is not rotational, such as linear movement or the like, in certain non-exemplified embodiments of the invention.

The bubble generating assembly 210 is operably coupled to the connection section 127 of the basin member 120 so that the bubble generating assembly 210 rotates about the first rotational axis A-A relative to the stationary basin member 120. The bubble generating assembly 210 is positioned within the apparatus 100 so that the follower member 212, and more specifically the follower arm 213, rides along the cam surface 128 as the bubble generating assembly 120 rotates about the first rotational axis A-A. Because the follower arm 213 is rotatably/pivotably coupled to the body 211 within the slot 226, as the follower arm 213 rides along the cam surface 128 the follower member 212 rotates/pivots between a raised position and a lowered position. Specifically, when the follower arm 213 is located along one of the raised portions 140, 141 of the cam surface 128, the follower member 212 is in a raised position. When the follower arm 213 is located along one of the valley portions 142, 143 of the cam surface 128, the follower member 212 is in the lowered position. The follower member 212 repetitively transitions between the raised and lowered positions as it continues to ride along the cam surface 128 during operation of the apparatus 100.

Furthermore, as noted above the raised portions 140, 141 of the cam surface 128 are aligned with the first and second air flow openings 125, 126 and the valley portions 142, 143 are aligned within the first and second reservoirs 123, 124 of the trough 122. Therefore, when the follower arm 213 is located along one of the raised portions 140, 141 of the cam surface 128, the bubble generating device 214 of that follower arm 213 is aligned with and positioned over one of the air flow openings 125, 126. When the follower arm 213 is located along one of the valley portions 142, 143 of the cam surface 128, the bubble generating device 214 of that follower arm 213 is positioned within one of the reservoirs 123, 124 of the trough 122. Thus, when the first and second reservoirs 123, 124 are filled with a bubble solution, the apparatus 100 generates bubbles as described below.

Figure 8:
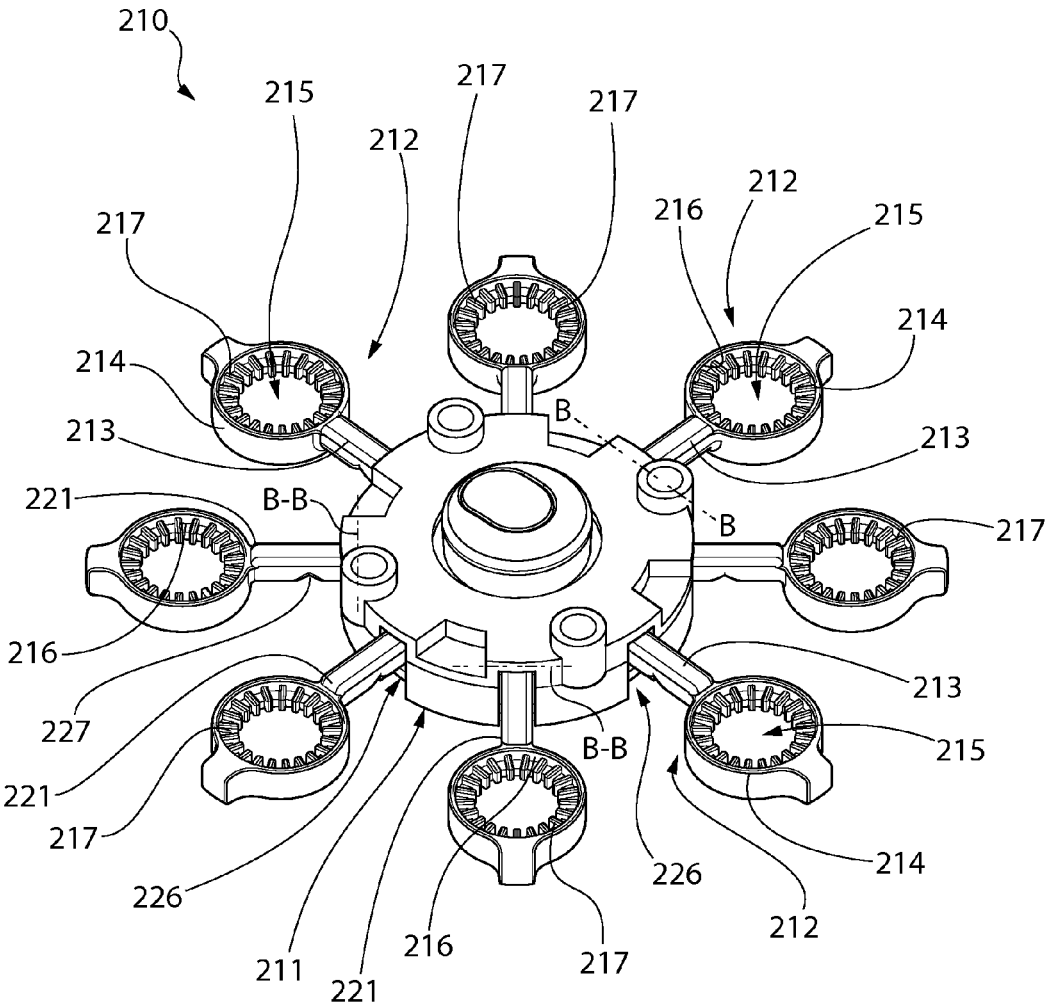
FIG. 8 is a perspective view of a bubble generating assembly of the apparatus for generating bubbles of FIG. 1.
Figure 9:
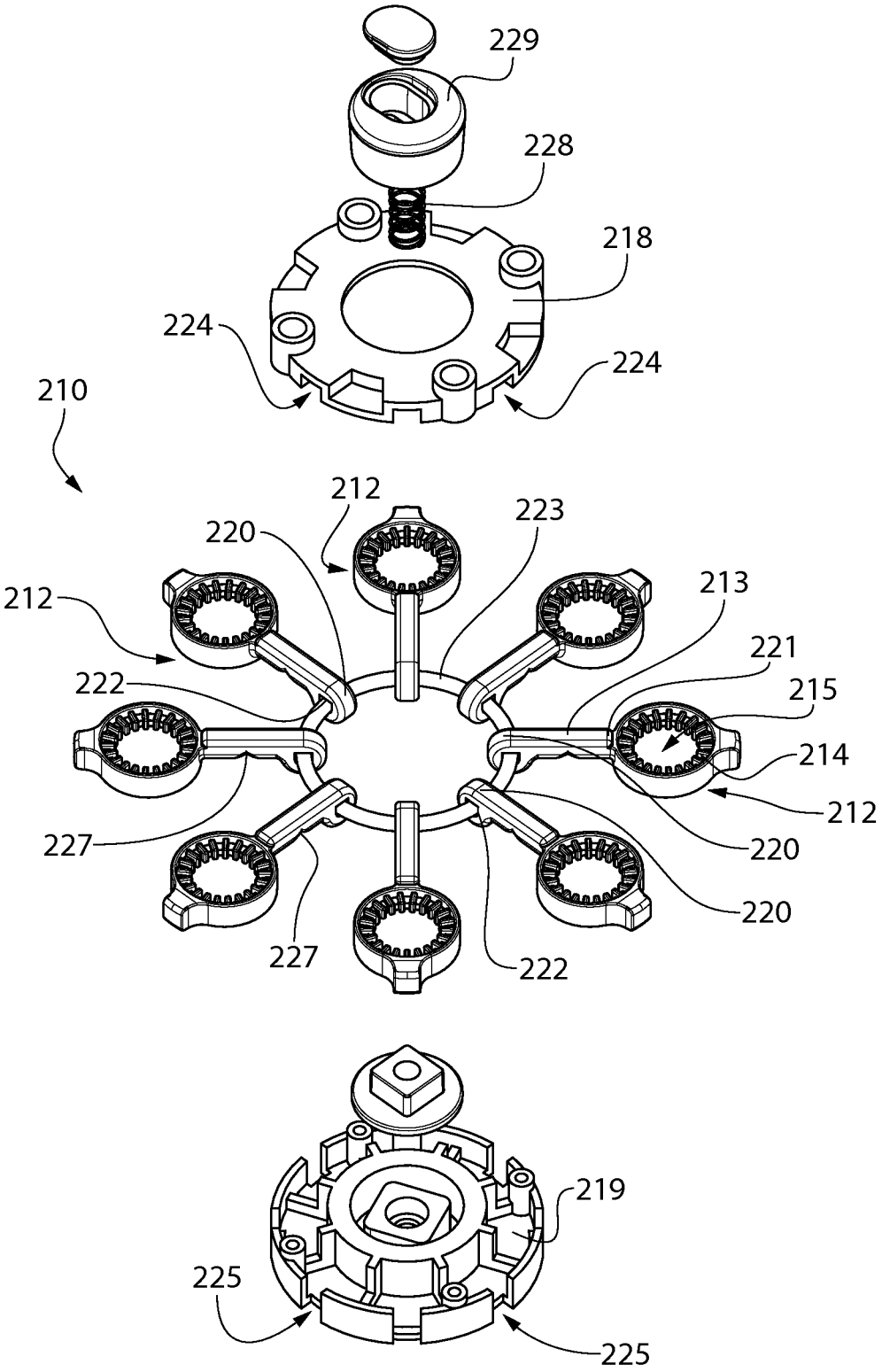
FIG. 9 is an exploded view of the bubble generating assembly of FIG. 8.
Figure 10:
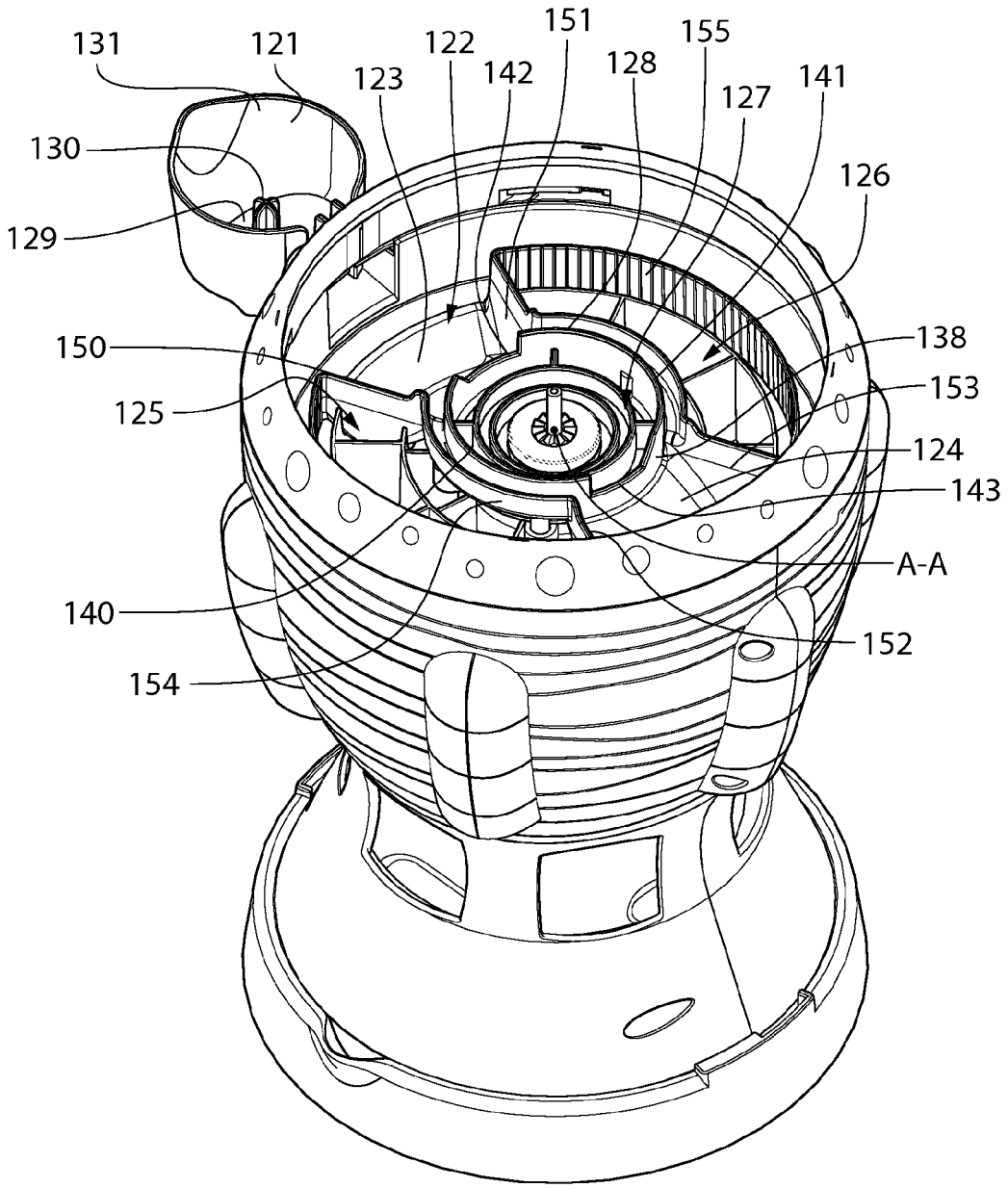
FIG. 10 is a perspective view of the apparatus for generating bubbles with the bubble generating assembly removed.
Figure 13A:
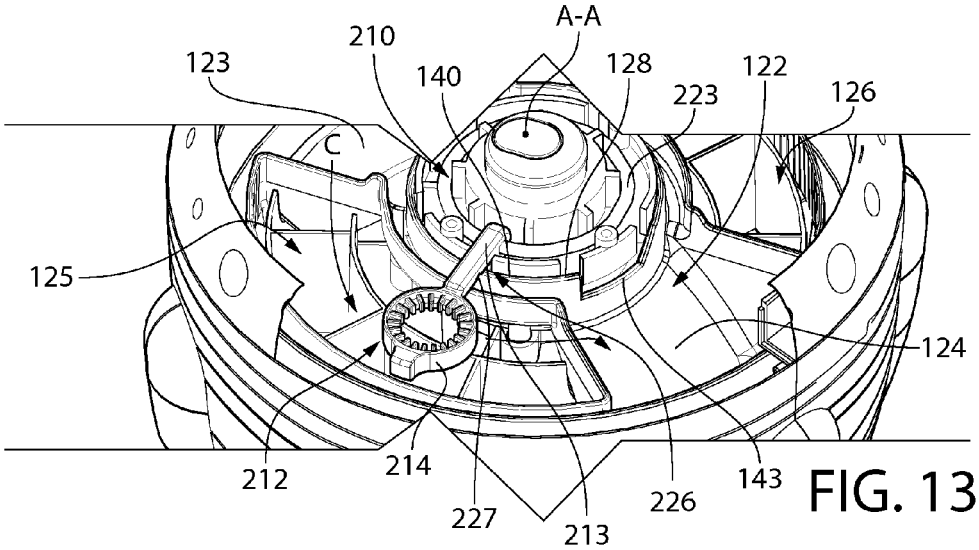
FIG. 13A is a perspective view of a portion of the apparatus for generating bubbles of FIG. 1 with a bubble generating device in a first position.
Figure 13B:
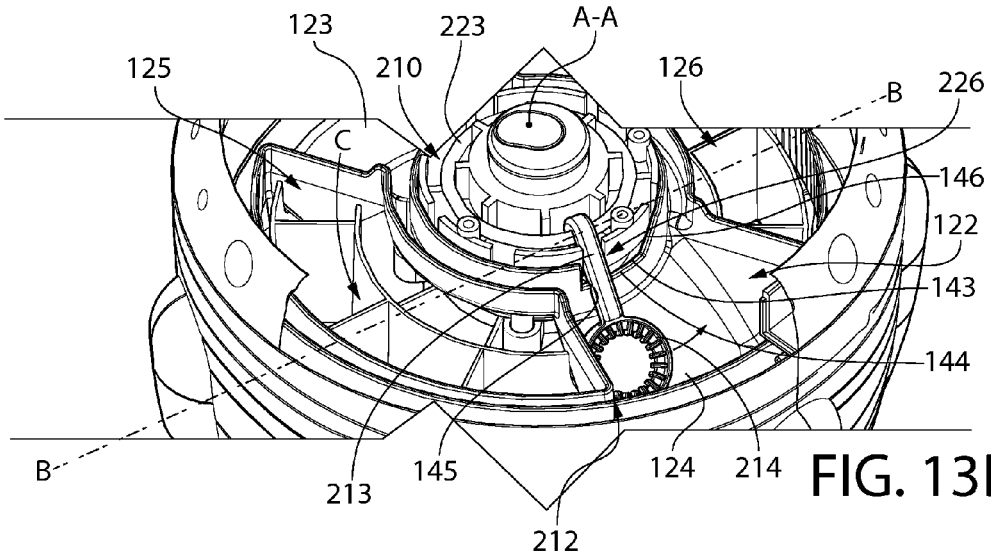
FIG. 13B is a perspective view of the portion of the apparatus for generating bubbles of FIG. 13A with the bubble generating device in a second position.
Figure 13C:
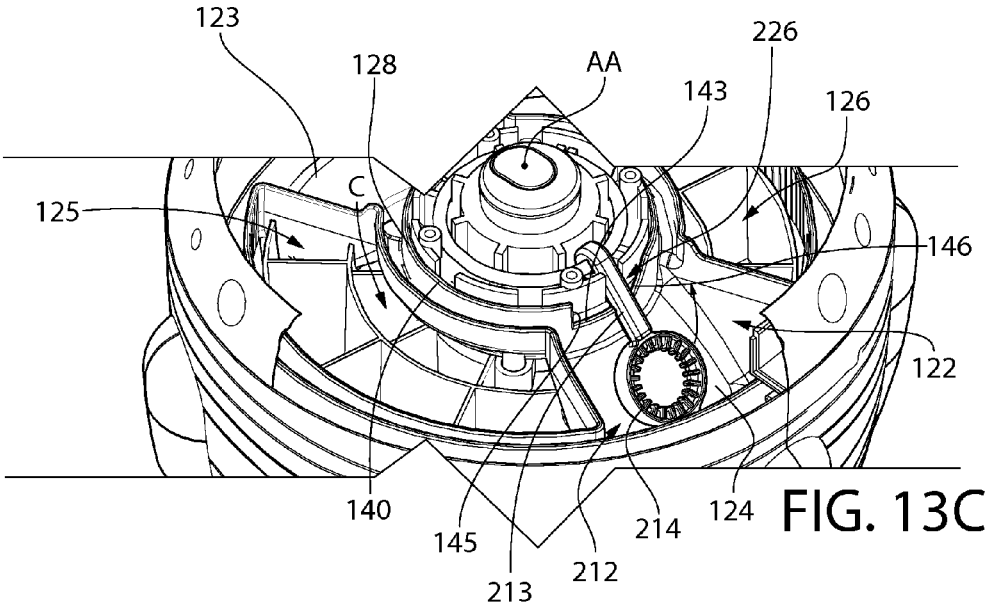
FIG. 13C is a perspective view of the portion of the apparatus for generating bubbles of FIG. 13A with the bubble generating device in a third position.
Figure 13D:
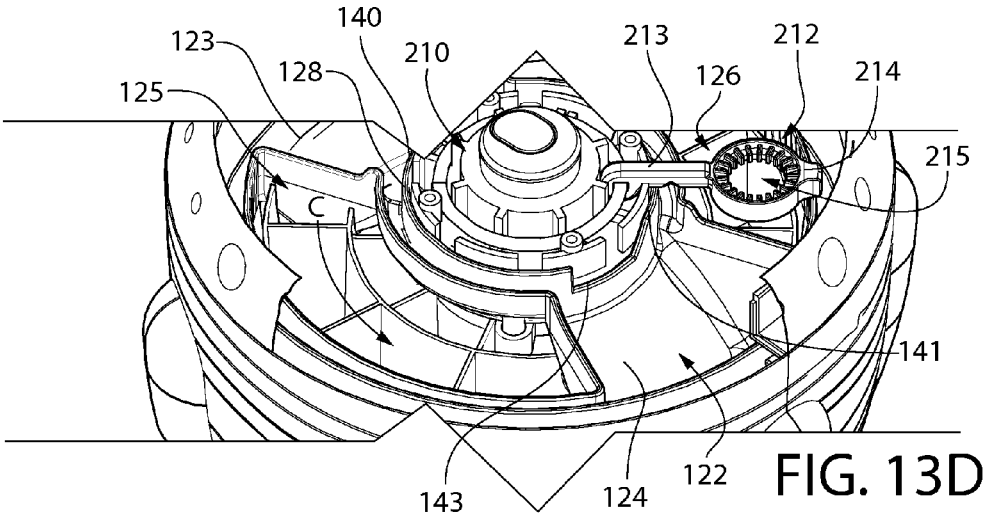
FIG. 13D is a perspective view of the portion of the apparatus for generating bubbles of FIG. 13A with the bubble generating device in a fourth position.
Figure 14:
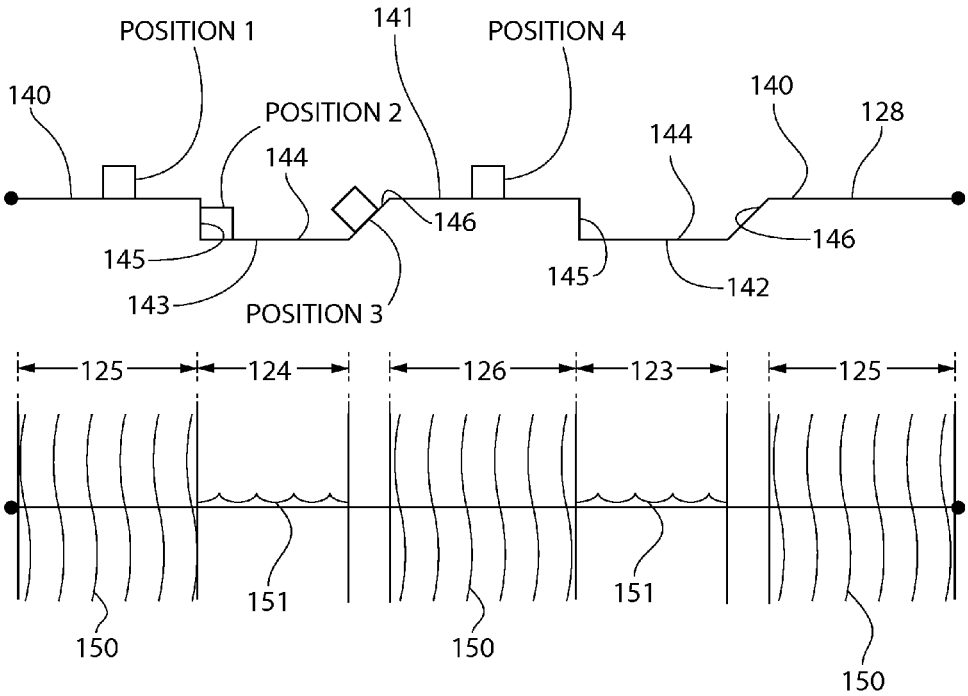
FIG. 14 is a schematic diagram illustrating the operation of the apparatus for generating bubbles based on the positioning of the bubble generating device.

Referring to FIGS. 13A-13D and 14, operation of the apparatus will be described. It is noted that in FIGS. 13A-13D the bubble generating assembly 210 is illustrated having only one follower member 212 with a follower arm 213 and a bubble generating device 214. This is for simplicity of explanation. It should be understood that multiple of the follower members 212, such as eight as depicted in the embodiment of FIGS. 1 and 8, can be used. FIG. 14 illustrates a schematic diagram of operation of the apparatus 100 regarding the action being applied to the bubble generating device 214. Specifically, in FIG. 14 the top line is a schematic representation of the cam surface 128 and the bottom line is a schematic representation of whether an air stream 250 is being applied to the bubble generating device 214, whether bubble solution 251 is being loaded onto the bubble generating device 214, or neither of those two actions are occurring. FIG. 14 is intended to be viewed in conjunction with FIGS. 13A-13D and the description below.

During operation, first the trough 122, and more specifically the first and second reservoirs 123, 124 of the trough 122, are filled with the bubble solution in the manner described herein above with reference to FIG. 12 or in any other desired manner. Specifically, rather than positioning the bubble bottle upside-down within the gravity-feed reservoir 121, the bubble solution can simply be poured into the trough 122 in any desired manner. After the trough 122 is filled with the bubble solution, the apparatus 100 is ready to generate bubbles. Thus, after the trough 122 is filled with the bubble solution, a user presses 112 the power button 112 on the apparatus 100.

Upon pressing the power button 112 on the apparatus 100, the motor 110 begins to rotate. Due to its operable coupling with the motor 110, as the motor 110 rotates the bubble generating assembly 210 rotates about the rotational axis A-A. As the bubble generating assembly 210 rotates about the rotational axis A-A, the follower arm 213 rides along the cam surface 128 in the direction of the arrow C. In the exemplified embodiment, the notch 227 of the follower arm 213 is positioned in direct surface contact with the cam surface 128 as the follower arm 213 rides along the cam surface 128. However, in certain embodiments the notch 227 may only be in surface contact with the cam surface 128 when the follower arm 213 is riding along the valley portions 142, 143 of the cam surface 128. This will enable the follower member 212 to be even lower when on the valley portions 142, 143 of the cam surface 128 and even more raised or higher when on the raised portions 140, 141 of the cam surface 128. Furthermore, upon pressing the power button 112, the air generating device 111 rotates along with the motor 110 due to its operable coupling with the motor 110. As the air generating device 111 rotates, the air generating device 111 generates an air stream that flows upwardly towards the open top end of the apparatus 100.

Referring to FIGS. 13A and 14 concurrently, the follower member 212 is illustrated in Position 1. Specifically, the follower member 212, and more specifically the follower arm 213, is located on the first raised portion 140 of the cam surface 128. When the follower member 212 is positioned on the first raised portion 140 of the cam surface 128, the follower member 212 is in the raised position. Furthermore, when the follower member 212 is positioned on the first raised portion 140 of the cam surface 128, the bubble generating device 214 is aligned with the first air opening 125. As discussed above, the air stream generated by the air generating device 111 flows upwardly through the first air opening 125. Thus, when the bubble generating device 114 is aligned with and positioned over the first air opening 125, the air stream 150 (FIG. 14) flows through the bubble generating device 114. If the bubble generating device 114 has been pre-loaded with bubble solution, the air stream 150 flowing through the bubble generating device 114 will produce bubbles from the bubble solution that will flow upwardly away from the apparatus 100.

As the bubble generating assembly 210 continues to move or, in the exemplified embodiment rotate about the rotational axis A-A in the direction of the arrow C, the bubble generating assembly 210 reaches Position 2, illustrated in FIGS. 13B and 14. In Position 2, the follower member 212 of the bubble generating assembly 210 is located on the second valley portion 143 of the cam surface 128 (it should be understood that the use of the terms "first" and "second" is not to be limiting of the present invention, but is merely intended to distinguish between two or more similar structures). Specifically, in the exemplified embodiment the follower member 212 rides along the first raised portion 140 of the cam surface 128 in the direction of the arrow C until it reaches the first wall 145 of the second valley portion 143 of the cam surface 128. Upon reaching the first wall 145 of the second valley portion 143 of the cam surface 128, the follower member 212 pivots about the second rotational axis B-B and falls downwardly along the first wall 145 and into contact with the floor 144 of the second valley portion 143.

Thus, upon reaching the second valley portion 143 of the cam surface 128, the follower member 212 pivots or rotates downwardly within the slot 226 of the body 211 of the bubble generating assembly 210 about the second rotational axis B-B. As the follower member 212 pivots or rotates downwardly about the second rotational axis B-B, the follower member 212 is in the lowered position and the bubble generating device 214 is positioned within the trough 122, and more specifically within the second reservoir 124 of the trough 122. When the bubble generating device 214 is positioned within the second reservoir 124 of the trough 122, which is filled with the bubble solution, the bubble solution 151 (FIG. 14) is loaded onto the bubble generating device 214.

As the bubble generating assembly 210 continues to rotate about the rotational axis A-A, the follower member 212 of the bubble generating assembly 210 rides along the second valley portion 143 of the cam surface 128 and the bubble generating device 214 remains positioned within the second reservoir 124. The follower arm 212 of the bubble generating assembly 210 is eventually located in Position 3. In Position 3, which is illustrated in FIG. 13C, the follower arm 212 is located on the second wall 146 of the second valley portion 143 of the cam surface 128. As the bubble generating assembly 210 continues to rotate, the follower arm 212 rides along the second wall 146 of the second valley portion 143 of the cam surface 128 and rotates upwardly about the second rotational axis B-B. The second wall 146, due to its being oriented at an acute angle relative to the floor 144 of the second valley portion 143 of the cam surface 128, forms a ramp which enables the follower arm 212 to ride its way upwardly along the cam surface 128 and out of the second reservoir 124. Thus, as the follower arm 212 rides along the second wall 146 of the second valley portion 143 of the cam surface 128, the follower arm 212 transitions from the lowered position to the raised position.

As depicted in FIG. 14, when the follower member 212 is located along the second wall 146 of the second valley portion 143 of the cam surface 128, there is neither bubble solution being loaded onto the bubble generating device 214 nor an air stream being blown through the bubble generating device 214. However, the invention is not to be so limited in all embodiments and in certain other embodiments while the follower member 212 rides along the second wall 146 of the second valley portion 143 of the cam surface 128, bubble solution continues to be loaded onto the bubble generating device 214. Whether or not the bubble generating device 214 is loaded with the bubble solution while the follower member 212 is located on or rides along the second wall 146 of the second valley portion 143 of the cam surface 128 is dependent upon the liquid level of the bubble solution within the second reservoir 124 of the trough 122. Specifically, if the liquid level is low, the bubble generating device 214 may not be positioned within the bubble solution while the follower member 212 rides along the second wall 146 of the second valley portion 143 of the cam surface 128. However, if the liquid level is high, the bubble generating device 214 may remain positioned within the bubble solution while the follower member 212 rides along the second wall 146 of the second valley portion 143 of the cam surface 128.

As the bubble generating assembly 210 continues to rotate in the direction of the arrow C, the follower arm 212 eventually reaches Position 4, which is illustrated in FIG. 13D. In Position 4, the follower arm 212 is located on the second raised portion 141 of the cam surface 128. When the follower arm 212 is located on the second raised portion 141 of the cam surface 128, the bubble generating device 214 is positioned over and aligned with the second air flow opening 126. In this position, the air stream 150 generated by the air flow generator 111 flows through the central aperture 215 of the bubble generating device 214 that is loaded with the bubble solution. As the air stream 150 flows through the central aperture 215 of the loaded bubble generating device 214, bubbles are produced from the bubble solution and flow upwardly away from the apparatus 100 in the direction of the flow of the air stream 150.

Although not depicted in FIGS. 13A-13D, the bubble generating assembly 210 continues to rotate about the first rotational axis A-A so that the follower member 212 rides along and is located on the first valley 142 of the cam surface 128. When the follower member 212 is located on the first valley 142 of the cam surface 128, the bubble solution 151 is loaded on the bubble generating device 214, which is located within the first reservoir 123. The follower member 212 then continues to ride along the cam surface 128, up the second wall 146 of the first valley portion 142, and back onto the first raised portion 140 of the cam surface 128 in which the bubble generating device 214 is again positioned over and aligned with the first air flow opening 125 where the air stream 150 flows through the bubble generating device 214 to produce bubbles.

The movement discussed above continues indefinitely as the apparatus 100 is powered on. Thus, the follower member 212 repetitively transitions between the lowered and raised positions as the follower member 212 continues to ride along the cam surface 228. The follower member 212 transitions between the raised position and the lowered position and between the lowered position and the raised position by rotation about the second rotational axis B-B.

Furthermore, as noted above, in certain embodiments the bubble generating assembly 210 comprises a plurality of the follower members 212 that are riding along the cam surface 128 simultaneously. In such an embodiment, each of the follower members 212 is positioned so as to be spaced apart from an adjacent one of the follower members 212. Furthermore, in one such embodiment that includes a plurality of the follower members 212, at least one of the follower members 212 is located along one of the valley portions 142, 143 of the cam surface 128 while at least one other of the follower members 212 is located along one of the raised portions 140, 141 of the cam surface 128. Thus, in such an embodiment one of the bubble generating devices 214 is being loaded within bubble solution while another one of the bubble generating devices 214, which has been pre-loaded with the bubble solution, is positioned so that the air stream flows therethrough for the production of bubbles.

Although in the exemplified embodiment, the cam surface 128 is annular and the bubble generating assembly 210 rotates about the first rotational axis A-A, the invention is not to be so limited in all embodiments. In certain embodiments, the cam surface 128 may be linear, while still including the raised and lowered portions. In such an embodiment, the bubble generating assembly 210 will translate in a linear direction so that the follower member 212 rides along the linear cam surface 128. The bubble generating device 214 can be made to alternate between being located in a reservoir filled with bubble solution and being positioned over an air flow opening as discussed above even with the cam surface 128 being linear and the movement being linear. Thus, the invention is not to be specifically limited by the arrangements depicted in the drawings in all embodiments.

Figure 15:
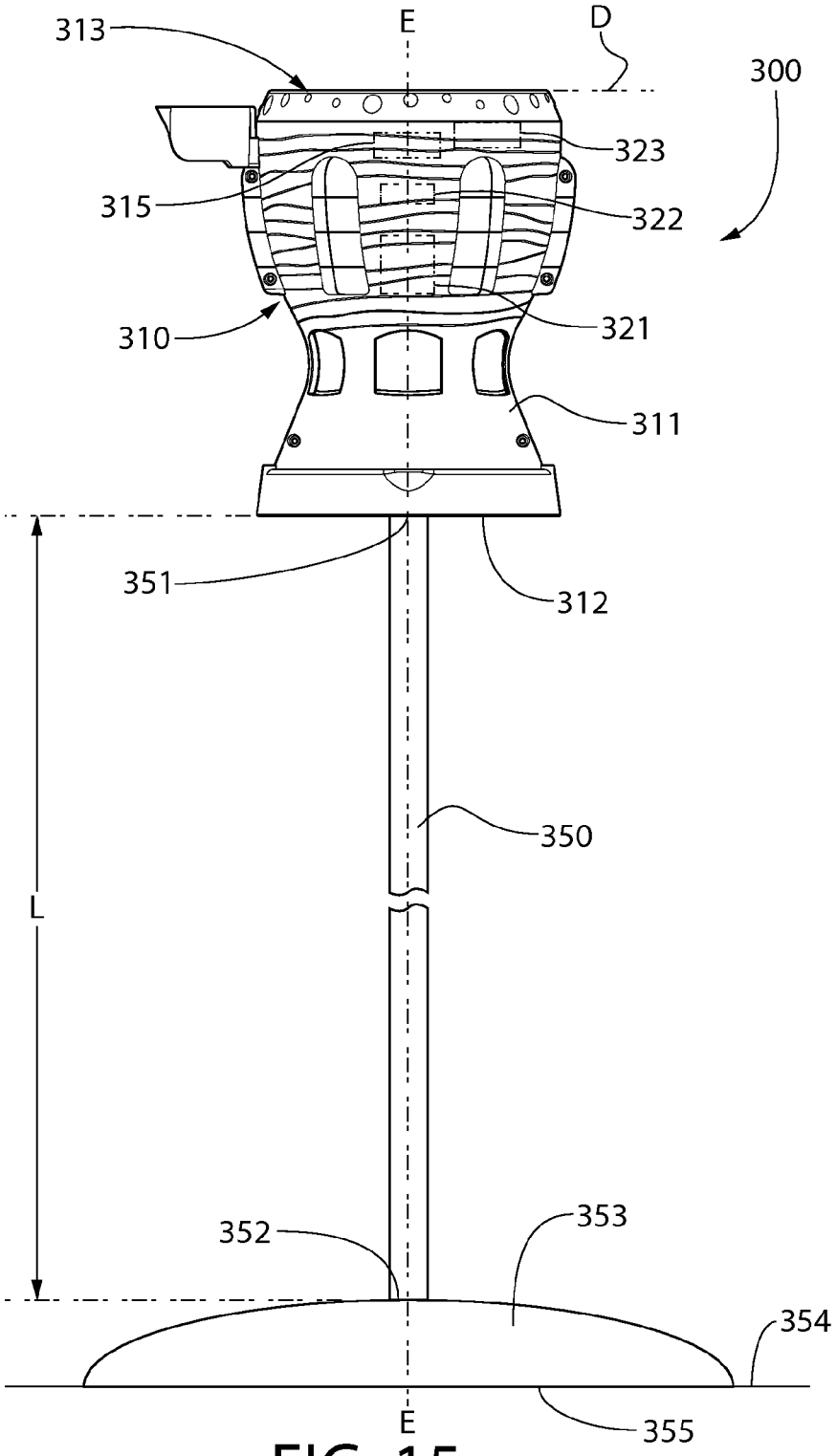
FIG. 15 is a front view of an apparatus for generating bubbles coupled to an elongated rod in accordance with an embodiment of the present invention.

Referring now to FIG. 15, a bubble producing flameless torch apparatus 300 (hereinafter "the torch apparatus 300) will be described in accordance with another embodiment of the present invention. The torch apparatus 300 generally comprises a bubble generating device 310 and an elongated rod 350 that supports the bubble generating device 310 above a horizontal surface. Specifically, the elongated rod 350 supports the bubble generating device 310 so that the bubble generating device 310 is elevated off of the ground. A plurality of the torch apparatuses 300 could be positioned around a yard to achieve a similar effect to that of a Tiki® torch.

The bubble generating device 310 may be the apparatus 100 described in detail herein above or any other apparatus that is capable of generating bubbles. Thus, the torch apparatus 300 may include affixing an elongated rod to any bubble generating devices now known or later developed. More specifically, in certain embodiments the bubble generating device 310 comprises a housing 311 having a closed bottom end 312 and an open top end 313. In one embodiment, the bubble generating device 310 is configured to generate bubbles that flow upwardly through the open top end 313 of the housing 311. However, the invention is not to be so limited in all embodiments and in certain other embodiments the bubble generating device 310 may be configured to generate bubbles that flow out through an opening in a side surface or in a bottom surface of the housing 311. This can be achieved utilizing the apparatus 100 described above or any other bubble generating device. Thus, the invention is not limited to the specific mechanisms and structures that facilitate bubble generation in all embodiments. However, in certain embodiments the bubble generating device 310 will include a motor 321, an air flow generator 322, a bubble producing assembly 323 that may include bubble producing wands and a source of bubble solution. The source of bubble solution is loaded onto the bubble producing assembly 323 during operation, and then an air stream generated by the air flow generator 322 is blown through the bubble producing wand of the bubble producing assembly 323 to produce bubbles from the bubble solution.

In certain embodiments, the bubble generating device 310 is any device that is configured to be loaded with bubble solution from a source of bubble solution to form a loaded bubble generating device and is also configured to produce bubbles from the bubble solution by flowing an air stream through the loaded bubble generating device. In one embodiment, the bubble generating device 310 includes the bubble producing assembly 323 that is operably coupled to the motor 321 so that the bubble producing assembly moves 323 between a first position and a second position. In such an embodiment, in the first position bubble producing wands of the bubble producing assembly 323 are loaded with bubble solution and in the second position an air stream flows through the loaded bubble producing wands to produce bubbles that flow upwardly from the open top end 313 of the housing 311.

In the exemplified embodiment, the elongated rod 350 is coupled to the closed bottom end 312 of the housing 311. The elongated rod 350 can be formed out of any desired material, including any of the various hard plastics described herein above, metals, metal alloys, wood or the like. The elongated rod 350 extends along a longitudinal axis E-E from a first end 351 to a second end 352. In one embodiment, the elongated rod 350 has a length L measured along the longitudinal axis E-E of between 6 inches and 60 inches. In other embodiments, the length L may be between 6 inches and 12 inches, between 6 inches and 24 inches, between 12 inches and 24 inches, between 12 inches and 36 inches, between 24 inches and 36 inches, between 24 inches and 48 inches, between 36 inches and 48 inches or between 36 inches and 60 inches. In still other embodiments, the length L may be less than 6 inches or greater than 60 inches. Thus, the length L of the elongated rod 350 is not to be limiting of the present invention in all embodiments and can be made adjustable in certain other embodiments by using telescoping rod elements, separately connectable rod elements, or the like.

The first end 351 of the elongated rod 350 is coupled to the closed bottom end 312 of the housing 311. In the exemplified embodiment, the second end 352 of the elongated rod 350 is coupled to or formed integrally with a base structure 353. The base structure 353, in the exemplified embodiment, is dome-shaped and has a flat bottom surface 355. During use, the flat bottom surface 355 of the base structure 353 is positioned atop of a horizontal surface 354, such as the ground. When so positioned, the base structure 353 supports the torch apparatus 300 in an upright orientation such that the elongated rod 350 extends upwardly from the horizontal surface 354 and the bubble generating device 310 is supported in an upright manner so that a plane D that extends along the open top end 313 of the bubble generating device 310 is substantially parallel or exactly parallel to the horizontal surface 354 (substantially parallel can include plus or minus 5° from exactly parallel). In this manner, if the bubble generating device 310 includes a trough for containing a bubble solution, the bubble solution will not spill out of the device 310.

Although the exemplified embodiment illustrates the base structure 353 for supporting the torch apparatus 300, the invention is not to be so limited in all embodiments. In certain other embodiments the elongated rod 350 may terminate in a pointed end to form a stake that can be inserted into the horizontal surface 354 when the horizontal surface 354 is the ground. In such embodiments, the elongated rod 350 can be inserted into the horizontal surface 354 to support the bubble generating device 310 in an elevated manner relative to the horizontal surface 354. In still other embodiments, the elongated rod 350 may not include a base structure 353 or a base. In such an embodiment, the elongated rod 350 may merely be a rod intended to be used as a handle for holding the torch apparatus 300. A user can walk around with the torch apparatus 300 by holding the elongated rod 350 while the bubble generating device 310 generates bubbles from the open top end 313 of the housing 311.

In the exemplified embodiment, the bubble generating device 310 also includes an illumination source 315 operably coupled to the housing 311. In the exemplified embodiment, the illumination source 315 is generically illustrated as a box. In that regard, in certain embodiments the exact structure, arrangement, size and positioning of the illumination source 315 is not to be particularly limiting of the present invention. Rather, the illumination source 315 can be any device capable of generating light and that light may be generated within the housing 311, that light may be emitted from the housing 311 either through the open top end 313 of the housing 311 or otherwise, or any other desired manner of emitting light may occur. Furthermore, it should be appreciated that in certain other embodiments the illumination source 315 may be altogether omitted.

The illumination source 315 may be located within the interior of the housing 311, on the exterior of the housing 311, or elsewhere as desired. In the exemplified embodiment, the illumination source 315 is located within the interior of the housing 311. The illumination source 315 may be any type of device that can generate light, such as one or more light emitting diodes (LEDs), one or more light bulbs including incandescent and fluorescent bulbs, or any other device capable of generating light. The illumination source 315 is operably coupled to a power source and to an illumination button (not shown) so that the illumination source 315 is generating light when the illumination button is pressed. The illumination source 315 may generate light having different colors in the visible spectrum, may flash or strobe at various speeds, or may be a constant generation of light.

In certain embodiments, the housing 311 may be transparent or translucent. In such embodiments, the illumination source 315 will light up the housing 311 and cause the housing 311 to glow. In other embodiments, the illumination source 315 may emit light from the open top end 313 of the housing 311. This can create more of a torch-like feel from the torch apparatus 300. In some embodiments, during bubble generation, the bubbles are generated and flow from the open top end 313 of the housing 311. Furthermore, the illumination source 315 may light up the bubbles as they flow away from the open top end 313 of the housing 311 to create a light show effect. Thus, there are various uses of the illumination source 315 that are within the scope of the present invention.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An apparatus for generating bubbles comprising:

a housing;

a motor;

a fan device operably coupled to the motor to generate an air stream;

a bubble generating assembly comprising a body and a follower member having a bubble generating device, the motor operably coupled to the bubble generating assembly to rotate the bubble generating assembly about a first rotational axis, the follower member pivotably coupled to the body so as to be pivotable about a second rotational axis;

an annular cam surface being one continuous structure and comprising a raised portion and a valley portion, the annular cam surface circumscribing the first rotational axis, the follower member resting atop and in continuous surface contact with the annular cam surface during a full rotation of the bubble generating assembly;

a gravity-feed reservoir configured to hold a container of bubble solution in an upside-down orientation so that an open end of the container is adjacent to a floor of the gravity-feed reservoir;

a trough fluidly coupled to the gravity-feed reservoir so that the bubble solution flows from the gravity-feed reservoir into the trough;

wherein upon the bubble generating assembly being rotated about the first rotational axis by the motor, the follower member rides along the annular cam surface to repetitively transition between: (1) a lowered position in which the follower member is located along the valley portion of the annular cam surface and the bubble generating device becomes loaded with bubble solution; and (2) a raised position in which the follower member is located along the raised portion of the annular cam surface and the bubble generating device is aligned with the air stream generated by the fan; and wherein the follower member transitions between the raised position and the lowered position by rotating about the second rotational axis.

2. The apparatus of claim 1 wherein when the follower member is in the lowered position the bubble generating device is positioned within the trough to load the bubble generating device with the bubble solution.

3. The apparatus of claim 2 further comprising an air flow opening, wherein when the follower member is in the raised position the bubble generating device is positioned over the air flow opening so that the air stream generated by the fan device flows through the air flow opening and through the bubble generating device for producing bubbles from the bubble solution loaded on the bubble generating device.

4. The apparatus of claim 3 wherein the air flow opening has a first arc length and the trough has a second arc length measured along any reference circle oriented perpendicular to and having a centerpoint at the first rotational axis, the first arc length being greater than the second arc length.

5. The apparatus of claim 2 wherein the annular cam surface is a top edge of an annular cam wall, the raised portion of the annular cam surface and a floor of the valley portion of the annular cam surface being a flat portion of the top edge of the annular cam wall, and wherein the trough comprises a floor that extends downwardly from the annular cam wall thereby forming an obtuse angle between the floor of the trough and the annular cam wall.

6. The apparatus of claim 1 wherein the trough comprises a first reservoir and a second reservoir that are spaced apart about the first rotational axis, a first annular channel having a first diameter and a second annular channel having a second diameter, the second diameter being greater than the first diameter, wherein each of the first and second annular channels fluidly couples the first reservoir to the second reservoir.

7. The apparatus of claim 6 further comprising a first air flow opening defined by a first upstanding wall and a second air flow opening defined by a second upstanding wall, each of the first and second upstanding walls forming a closed perimeter that surrounds the first and second air flow openings respectively, wherein the air stream generated by the fan device flows through each of the first and second air flow openings, and wherein when the follower member is in the raised position the bubble generating device is positioned over one of the first and second air flow openings.

8. The apparatus of claim 7 wherein the first air flow opening is located between a first side of the first reservoir and a first side of the second reservoir and the second air flow opening is located between a second side of the first reservoir and a second side of the second reservoir.

9. The apparatus of claim 7 wherein the annular cam surface, the first and second reservoirs and the first and second air flow openings are formed into a basin member, wherein the annular cam surface is a top edge of an annular cam wall, wherein the first annular channel is formed between the annular cam wall and an inner portion of the first and second upstanding walls and wherein the second annular channel is formed between an outer portion of the first and second upstanding walls and a perimetric wall of the basin member.

10. The apparatus of claim 1 further comprising:

the trough comprising a first reservoir and a second reservoir;

a first air flow opening located between a first side of the first reservoir and a first side of the second reservoir;

a second air flow opening located between a second side of the first reservoir and a second side of the second reservoir;

the annular cam surface comprising first and second raised portions and first and second valleys, the first raised portion aligned with the first air flow opening, the second raised portion aligned with the second air flow opening, the first valley portion aligned with the first reservoir, and the second valley portion aligned with the second reservoir.

11. The apparatus of claim 10 wherein when the follower member is in the lowered position the bubble generating device is positioned within one of the first and second reservoirs of the trough to load the bubble generating device with the bubble solution, and wherein when the follower member is in the raised position the bubble generating device is positioned over one of the first and second air flow openings so that the air stream generated by the fan device flows through the bubble generating device.

12. The apparatus of claim 1 wherein the bubble generating assembly comprises the body and a plurality of the follower members, each of the follower members having at least one bubble generating device, and wherein each of the follower members is separately pivotably coupled to the body.

13. The apparatus of claim 12 wherein as the bubble generating assembly is rotated about the first rotational axis by the motor, at least one of the follower members is located along the valley portion of the annular cam surface and at least one of the follower members is located along the raised portion of the annular cam surface.

14. The apparatus of claim 1 wherein the valley portion of the annular cam surface comprises a floor and first and second walls extending from the floor of the valley portion to the raised portion, wherein the first wall is oriented substantially perpendicular to the floor and wherein the second wall is oriented at an obtuse angle relative to the floor, the second wall forming a ramp to transition the follower member from the lowered position to the raised position.

15. An apparatus for generating bubbles comprising:

a housing;

at least one motor;

an air flow generator operably coupled to the at least one motor;

a trough for containing a bubble solution;

an annular cam surface comprising a raised portion and a valley portion, the annular cam surface being one continuous structure and circumscribing a rotational axis of a bubble generating device;

a follower member comprising the bubble generating device, the follower member resting atop and in continuous surface contact with the annular cam surface;

the at least one motor operably coupled to the follower member to drive the follower member along the annular cam surface in a repetitive cycle such that: (1) upon the follower member being located along the valley portion of the annular cam surface, the bubble generating device of the follower member is in the trough for loading with the bubble solution; and (2) upon the follower member being located along the raised portion of the annular cam surface, the bubble generating device of the follower member is aligned with an air flow generated by the air flow generator for producing bubbles from the bubble solution loaded on the bubble generating device.

16. The apparatus of claim 15 further comprising an air flow opening positioned so that the air flow generated by the air flow generator flows through the air flow opening, and wherein when the follower member is located along the raised portion of the annular cam surface, the bubble generating device is positioned over and aligned with the air flow opening.

17. The apparatus of claim 15 further comprising:

the trough comprising a first reservoir and a second reservoir;

a first air flow opening located between a first side of the first reservoir and a first side of the second reservoir;

a second air flow opening located between a second side of the first reservoir and a second side of the second reservoir;

the annular cam surface comprising first and second raised portions and first and second valley portions, the first raised portion aligned with the first air flow opening, the second raised portion aligned with the second air flow opening, the first valley portion aligned with the first reservoir, and the second valley portion aligned with the second reservoir; and wherein when the follower member is located along the first valley portion of the annular cam surface the bubble generating device is positioned within the first reservoir of the trough, when the follower member is located along the second valley portion of the annular cam surface the bubble generating device is positioned within the second reservoir of the trough, when the follower member is located along the first raised portion of the annular cam surface the bubble generating device is positioned over the first air flow opening, and when the follower member is located along the second raised portion of the annular cam surface the bubble generating device is positioned over the second air flow opening.

18. The apparatus of claim 15 wherein the annular cam surface is a top edge of an annular cam wall, and wherein the trough has a floor that extends downwardly from the annular cam wall thereby forming an obtuse angle between the floor and the annular cam wall.

19. A method of generating bubbles comprising:

positioning a container of bubble solution in an upside-down orientation within a gravity-feed reservoir so that the bubble solution flows out of the container and into the gravity-feed reservoir, the bubble solution flowing from the gravity-feed reservoir into a trough to fill the trough with the bubble solution;

generating an air stream with an air stream generator that is operably coupled to a motor;

moving a follower member having a bubble generating device along an annular cam surface, the annular cam surface comprising a raised portion and a valley portion, the annular cam surface being one continuous structure and circumscribing a rotational axis of the bubble generating device, the follower member resting atop and in continuous surface contact with the annular cam surface;

loading the bubble solution onto the bubble generating device when the follower member is located along the valley portion of the annular cam surface; and flowing the air stream through the bubble generating device when the follower member is located along the raised portion of the annular cam surface to produce bubbles from the bubble solution loaded on the bubble generating device.

20. The method of claim 19 wherein when the follower member is located along the raised portion of the annular cam surface the bubble generating device is positioned over an air stream opening and when the follower member is located along the valley portion of the annular cam surface the bubble generating device is located within the trough.

21. The method of claim 19 wherein the bubble solution flowing from the gravity-feed reservoir into the trough further comprises:

the bubble solution flowing from the gravity-feed reservoir into a first reservoir of the trough to fill the first reservoir of the trough with the bubble solution the annular cam surface being one continuous structure and circumscribing a rotational axis of a bubble generating device; and the bubble solution flowing through at least one annular channel that fluidly couples the first reservoir of the trough to a second reservoir of the trough to fill the second reservoir of the trough with the bubble solution.

* * * * *